US011701854B2

(12) United States Patent
Blomberg et al.

(10) Patent No.: US 11,701,854 B2
(45) Date of Patent: Jul. 18, 2023

(54) PACKAGING MACHINE AND SYSTEMS

(71) Applicant: Packsize LLC, Salt Lake City, UT (US)

(72) Inventors: Johan Blomberg, Uppsala (SE); Niklas Pettersson, Västerås (SE)

(73) Assignee: PACKSIZE LLC

( * ) Notice: Subject to any disclaimer, the term of this patent is extended or adjusted under 35 U.S.C. 154(b) by 202 days.

(21) Appl. No.: 16/814,509

(22) Filed: Mar. 10, 2020

(65) Prior Publication Data

US 2020/0290303 A1 Sep. 17, 2020

Related U.S. Application Data

(60) Provisional application No. 62/818,570, filed on Mar. 14, 2019.

(51) Int. Cl.

| | |
|---|---|
| ***B31B 50/00*** | (2017.01) |
| ***B31B 50/04*** | (2017.01) |
| ***B31B 50/06*** | (2017.01) |
| *B31B 120/30* | (2017.01) |

(52) U.S. Cl.

CPC ..... *B31B 50/006* (2017.08); *B31B 50/042* (2017.08); *B31B 50/06* (2017.08); *B31B 2120/30* (2017.08)

(58) Field of Classification Search

CPC ..... B31B 50/146; B31B 50/256; B31B 50/16; B31B 50/06; B31B 50/006; B31B 2120/30

See application file for complete search history.

(56) References Cited

U.S. PATENT DOCUMENTS

| | | | | |
|---|---|---|---|---|
| 1,183,744 A * | 5/1916 | Leach | B31B 50/25 493/370 |
| 1,924,160 A * | 8/1933 | Knowlton | B31B 50/00 493/364 |
| 2,077,428 A | 4/1937 | Robert | |
| 2,083,351 A | 7/1937 | Sidebotham | |
| 2,181,117 A | 11/1939 | Brenn | |
| 2,256,082 A | 9/1941 | Feurt | |
| 2,395,352 A * | 2/1946 | Staude | B31B 50/624 34/68 |
| 2,449,663 A | 9/1948 | Marcalus | |

(Continued)

FOREIGN PATENT DOCUMENTS

| | | |
|---|---|---|
| CN | 2164350 | 5/1994 |
| CN | 1191833 | 9/1998 |

(Continued)

OTHER PUBLICATIONS

U.S. Appl. No. 62/447,714 filed Jan. 18, 2017, Osterhout.

(Continued)

*Primary Examiner* — Thomas M Wittenschlaeger
(74) *Attorney, Agent, or Firm* — Workman Nydegger

(57) ABSTRACT

A converting assembly performs a plurality of conversion functions on sheet material to convert the sheet material into packaging templates. The converting assembly includes a plurality of tool rollers. Each of the tool rollers has one or more conversion tools thereon. The one or more conversion tools on an individual tool roller are configured to perform a subset of the plurality of conversion functions that convert the sheet material into packaging templates.

47 Claims, 10 Drawing Sheets

(56) References Cited

U.S. PATENT DOCUMENTS 2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe
3,039,369 A * 6/1962 Welsh ..... B31B 70/00 493/417
3,096,692 A 7/1963 Crathern et al.
3,105,419 A 10/1963 La Bombard
3,108,515 A 10/1963 Stohlquist
3,152,526 A * 10/1964 Dunton ..... B31B 50/16 493/401
3,303,759 A 2/1967 Burke
3,418,893 A 12/1968 Stohlquist
3,469,508 A 9/1969 Klapp
3,511,496 A 5/1970 Zoglmann
3,566,755 A 3/1971 Smith et al.
3,618,479 A 11/1971 Shields
3,628,408 A 12/1971 Rod et al.
3,646,418 A 2/1972 Sterns et al.
3,743,154 A 7/1973 Brewitz
3,776,109 A 12/1973 Clark et al.
3,803,798 A 4/1974 Clancy
3,804,514 A 4/1974 Jasinski
3,807,726 A 4/1974 Hope
3,882,764 A * 5/1975 Johnson ..... B26D 7/2635 83/504
3,891,203 A 6/1975 Schiff
3,912,389 A 10/1975 Miyamoto
3,913,464 A 10/1975 Flaum
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,133,254 A * 1/1979 Odom ..... B31B 50/00 493/131
4,164,171 A 8/1979 Meyers et al.
4,173,106 A 11/1979 Garcia et al.
4,191,467 A 3/1980 Schieck
4,224,847 A * 9/1980 Tokuno ..... B26D 7/2635 83/482
4,261,239 A * 4/1981 Toboshi ..... B26D 7/2635 83/508.3
4,264,200 A 4/1981 Tickner
4,295,841 A 10/1981 Ward, Jr.
4,320,960 A 3/1982 Ward et al.
4,368,052 A 1/1983 Bitsky et al.
4,373,412 A 2/1983 Gerber et al.
4,375,970 A 3/1983 Murphy
4,449,349 A * 5/1984 Roth ..... B65B 61/02 53/208
4,487,596 A 12/1984 Livens et al.
4,563,169 A 1/1986 Virta et al.
D286,044 S 10/1986 Kando
4,618,342 A * 10/1986 Borel ..... B26D 7/265 493/477
4,638,696 A 1/1987 Urwyler
4,695,006 A * 9/1987 Pool ..... B26D 1/035 242/542.4
4,714,946 A 12/1987 Bajgert
4,743,131 A 5/1988 Atwell
4,749,295 A 6/1988 Bankier
4,773,781 A 9/1988 Bankier
4,838,468 A 6/1989 Lesse
4,847,632 A 7/1989 Norris
4,878,521 A 11/1989 Fredrickson
4,887,412 A 12/1989 Takamura
4,923,188 A 5/1990 Neir
4,931,031 A * 6/1990 Lisiecki ..... B31F 7/006 493/60
4,932,930 A 6/1990 Coalier et al.
4,979,932 A 12/1990 Burnside
4,996,898 A * 3/1991 Miller ..... B26D 7/2635 83/13
5,005,816 A 4/1991 Stemmler
5,039,242 A 8/1991 Johnson
5,046,716 A 9/1991 Lippold
5,058,872 A 10/1991 Gladow
5,072,641 A * 12/1991 Urban ..... B26D 7/2635 83/508.3
5,081,487 A 1/1992 Hoyer
5,090,281 A 2/1992 Paulson
5,111,252 A 5/1992 Hamada
5,118,093 A 6/1992 Makiura
5,120,279 A 6/1992 Adami
5,120,297 A * 6/1992 Adami ..... B31B 50/16 83/479
5,123,890 A * 6/1992 Green, Jr. ..... B65H 35/08 270/52.09
5,123,894 A 6/1992 Bergeman
5,137,172 A 8/1992 Wagner
5,137,174 A 8/1992 Bell
5,197,366 A 3/1993 Paulson
5,240,243 A 8/1993 Gompertz
5,241,353 A 8/1993 Maeshima
5,259,255 A * 11/1993 Urban ..... B26D 7/2635 83/508.3
5,263,785 A 11/1993 Negoro
D344,751 S 3/1994 Keong
5,321,464 A 6/1994 Jessen
2,353,419 A 7/1994 Smithson
5,335,777 A 8/1994 Murphy
5,358,345 A 10/1994 Damitio
5,369,939 A 12/1994 Moen et al.
5,375,390 A 12/1994 Frigo et al.
5,411,252 A 5/1995 Lowell
5,584,633 A 12/1996 Scharer
5,586,758 A 12/1996 Kimura
5,624,369 A 4/1997 Bidlack et al.
5,671,593 A 9/1997 Ginestra et al.
5,716,313 A 2/1998 Sigrist et al.
5,727,725 A 3/1998 Paskvich
5,779,617 A * 7/1998 Larkin ..... B26D 7/2635 493/403
5,836,498 A 11/1998 Turek
5,902,223 A 5/1999 Simmons
5,927,702 A 7/1999 Ishii
5,941,451 A 8/1999 Dexter
5,951,454 A * 9/1999 Adami ..... B26D 5/02 493/355
5,964,686 A 12/1999 Bidlack et al.
6,000,525 A 12/1999 Frulio
6,071,222 A * 6/2000 Schneider ..... B26D 1/245 493/402
6,164,045 A 12/2000 Focke
6,189,933 B1 2/2001 Felderman
6,190,297 B1 * 2/2001 Croft ..... B31F 1/10 493/353
6,321,650 B1 11/2001 Ogawa
6,397,557 B1 6/2002 Bassissi
6,428,000 B1 8/2002 Hara
6,471,154 B2 10/2002 Zsolt
6,553,207 B2 4/2003 Tsusaka
6,565,499 B2 * 5/2003 Benzoni ..... B26D 3/14 493/240
6,568,865 B1 5/2003 Fujioka
6,830,328 B2 12/2004 Cuyler, Jr.
6,837,135 B2 1/2005 Michalski
6,840,898 B2 * 1/2005 Pettersson ..... G05B 19/19 493/473
6,926,653 B2 * 8/2005 Georgiades ..... B31B 50/16 493/82
6,968,859 B1 11/2005 Nagano et al.
7,100,811 B2 9/2006 Pettersson
7,121,543 B2 10/2006 Fujioka
7,237,969 B2 7/2007 Bartman
7,637,857 B2 12/2009 Coullery et al.
7,641,190 B2 1/2010 Hara

(56) References Cited

U.S. PATENT DOCUMENTS 7,647,752 B2 1/2010 Magnell
7,648,451 B2 1/2010 Calugi
7,648,596 B2 1/2010 Sharpe et al.
7,690,099 B2 4/2010 Bapst et al.
7,819,791 B1 * 10/2010 Ross ..... B65D 5/4204 493/309
7,997,578 B2 8/2011 Saito
8,011,284 B2 * 9/2011 Rinaldo ..... B26D 3/12 83/498
8,480,550 B2 * 7/2013 Taketsugu ..... B65H 29/62 53/53
D703,246 S 4/2014 Pettersson et al.
9,027,737 B2 * 5/2015 Talken ..... B26D 7/18 198/496
9,120,284 B2 * 9/2015 Capoia ..... B26D 7/2635
9,199,794 B2 12/2015 Nadachi et al.
9,329,565 B2 5/2016 Osaki
9,352,526 B2 * 5/2016 Pettersson ..... B31B 50/14
9,969,142 B2 * 5/2018 Pettersson ..... B31B 50/14
10,093,438 B2 * 10/2018 Pettersson ..... B65B 59/02
10,328,590 B2 * 6/2019 Bormann ..... B26D 7/018
10,759,079 B2 * 9/2020 Smithwick ..... B26D 7/1818
10,836,516 B2 * 11/2020 Pettersson ..... B31B 50/005
2002/0017754 A1 2/2002 Kang
2002/0066683 A1 6/2002 Sanders
2002/0091050 A1 7/2002 Bacciottini
2002/0115548 A1 8/2002 Lin et al.
2002/0125712 A1 9/2002 Felderman
2002/0139890 A1 10/2002 Toth
2003/0102244 A1 6/2003 Sanders
2003/0106899 A1 * 6/2003 Langen ..... B65D 5/542 99/323.5
2003/0191001 A1 * 10/2003 Guiot ..... B31B 50/86 493/82
2033/0217628 11/2003 Michalski
2004/0060264 A1 4/2004 Miller
2004/0082453 A1 * 4/2004 Pettersson ..... G05B 19/19 493/180
2004/0089692 A1 * 5/2004 Pettersson ..... B65H 20/00 226/1
2004/0092374 A1 5/2004 Chiu-Fu
2004/0261365 A1 12/2004 White
2005/0079965 A1 4/2005 Moshier et al.
2005/0103923 A1 5/2005 Pettersson
2005/0215409 A1 9/2005 Abramson et al.
2005/0280202 A1 12/2005 Vila
2006/0180991 A1 8/2006 Nakahata et al.
2006/0181008 A1 8/2006 Van Gerven
2007/0079575 A1 4/2007 Monti
2007/0228119 A1 10/2007 Barner
2007/0287623 A1 12/2007 Carlson
2007/0289253 A1 12/2007 Miller
2008/0020916 A1 1/2008 Magnell
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2009/0223180 A1 * 9/2009 Martocchio ..... B65H 29/6663 53/446
2010/0041534 A1 2/2010 Harding
2010/0111584 A1 5/2010 Shiohara
2010/0236431 A1 * 9/2010 Roberts ..... B31F 1/07 101/23
2011/0026999 A1 2/2011 Kohira
2011/0092351 A1 4/2011 Hatano
2011/0099782 A1 5/2011 Schonberger
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 9/2011 Pettersson
2012/0021884 A1 1/2012 Musha
2012/0129670 A1 5/2012 Pettersson et al.
2012/0139670 A1 6/2012 Yamagata
2012/0222937 A1 * 9/2012 Talken ..... B31B 50/042 198/496
2013/0000252 A1 1/2013 Pettersson et al.
2013/0045847 A1 2/2013 Capoia
2013/0130877 A1 5/2013 Su
2013/0210597 A1 8/2013 Pettersson
2013/0333538 A1 12/2013 Long et al.
2014/0091511 A1 3/2014 Martin
2014/0101929 A1 4/2014 Kim
2014/0162862 A1 * 6/2014 Shimura ..... B31B 50/00 493/56
2014/0315701 A1 10/2014 Pettersson
2014/0336026 A1 11/2014 Pettersson
2014/0357463 A1 12/2014 Kojima
2015/0018189 A1 * 1/2015 Pettersson ..... B65H 29/52 493/395
2015/0019387 A1 1/2015 Pettersson
2015/0053349 A1 2/2015 Mori et al.
2015/0103923 A1 4/2015 Ramasubramonian et al.
2015/0148210 A1 5/2015 Robert
2015/0224731 A1 * 8/2015 Ponti ..... B65D 5/2095 493/59
2015/0273897 A1 10/2015 Kato
2015/0360433 A1 12/2015 Feijen et al.
2015/0360801 A1 12/2015 Sytema
2016/0001441 A1 1/2016 Osterhout et al.
2016/0121572 A1 * 5/2016 Giancaterino ..... B31B 50/16 493/362
2016/0122044 A1 5/2016 Evers
2016/0185475 A1 6/2016 Pettersson et al.
2016/0340067 A1 11/2016 Winkler et al.
2017/0355166 A1 12/2017 Jonker
2017/0361560 A1 12/2017 Osterhout
2018/0178476 A1 6/2018 Pettersson et al.
2018/0201465 A1 7/2018 Osterhout
2018/0264766 A1 * 9/2018 Veis ..... B31B 50/25
2018/0265228 A1 9/2018 Hagestedt
2018/0339416 A1 * 11/2018 Bormann ..... B26D 7/018
2019/0152182 A1 * 5/2019 Hedberg ..... B26F 1/40
2020/0009818 A1 * 1/2020 Walsh ..... B31B 50/042
2020/0101686 A1 * 4/2020 Fredander ..... B26D 1/225

FOREIGN PATENT DOCUMENTS

CN 1366487 8/2002
CN 1876361 12/2006
CN 102371705 3/2012
CN 202412794 9/2012
CN 102753442 10/2012
CN 104169073 11/2014
CN 104185538 12/2014
CN 204773785 11/2015
DE 1212854 3/1966
DE 19541061 11/1996
DE 10355544 6/2005
DE 102005063193 7/2007
DE 102008035278 4/2010
EP 30366 6/1981
EP 359005 3/1990
EP 650827 5/1995
EP 889779 1/1999
EP 903219 3/1999
EP 1065162 1/2001
EP 1223107 7/2002
EP 1373112 1/2004
EP 1997736 12/2008
EP 1497049 3/2010
EP 2228206 9/2010
FR 428967 9/1911
FR 1020458 2/1953
FR 1592372 5/1970
FR 2721301 12/1995
FR 2770445 5/1999
FR 2808722 11/2001
FR 2976561 12/2012

(56) References Cited

FOREIGN PATENT DOCUMENTS

| | | |
|---|---|---|
| GB | 983946 | 2/1965 |
| GB | 1362060 | 7/1974 |
| JP | S5557984 | 4/1980 |
| JP | S5689937 | 7/1981 |
| JP | S59176836 | 10/1984 |
| JP | S61118720 | 7/1986 |
| JP | H08238690 | 9/1996 |
| JP | H08333036 | 12/1996 |
| JP | 2000323324 | 11/2000 |
| JP | 2003079446 | 3/2003 |
| JP | 2005067019 | 3/2005 |
| JP | 2005219798 | 8/2005 |
| JP | 2006289914 | 10/2006 |
| JP | 2008254789 | 10/2008 |
| JP | 2009132049 | 6/2009 |
| JP | 2011520674 | 7/2011 |
| JP | 2011230385 | 11/2011 |
| RU | 2015030 | 6/1994 |
| RU | 2004136918 | 5/2006 |
| RU | 2398674 | 9/2010 |
| SE | 450829 | 8/1987 |
| SU | 1054863 | 11/1983 |
| SU | 1718783 | 3/1992 |
| WO | 199614773 | 6/1996 |
| WO | 1999/017923 | 4/1999 |
| WO | 2003089163 | 10/2003 |
| WO | 2010091043 | 8/2010 |
| WO | 2011007237 | 1/2011 |
| WO | 2011100078 | 8/2011 |
| WO | 2011135433 | 11/2011 |
| WO | 2012003167 | 1/2012 |
| WO | 2013071073 | 5/2013 |
| WO | 2013071080 | 7/2013 |
| WO | 2013106180 | 7/2013 |
| WO | 2013114057 | 8/2013 |
| WO | 2016/176271 | 11/2016 |
| WO | 2017203401 | 11/2017 |
| WO | 2017218296 | 12/2017 |
| WO | 2017218297 | 12/2017 |

OTHER PUBLICATIONS

U.S. Appl. No. 15/872,770 filed Jan. 16, 2018, Osterhout.
U.S. Appl. No. 16/310,406 filed Dec. 14, 2018, Pettersson et al.
European Search Report for EP80107577.1 dated Mar. 2, 1981.
European Search Report for EP89115688.7 dated Nov. 2, 1989.
International Search Report and Written Opinion for application No. PCT/US2010/022983 dated Apr. 13, 2010.
International Search Report for PCT/US2011/042096 dated Oct. 28, 2011.
International Search Report and Written Opinion for PCT/US2012/064414 dated Jan. 25, 2013.
European Search Report for EP10739040 dated Jan. 31, 2013.
International Search Report and Wirtten Opinion for application No. PCT/US2012/070719 dated Feb. 25, 2013.
International Search Report and Written Opinion for PCT/US2012/064403 dated Apr. 8, 2013.
European Search Report for EP12848321 dated Jul. 1, 2015.
European Search Report for EP12865028 dated Jul. 7, 2015.
International Search Report and Written Opinion for PCT/US2015/67375 dated Mar. 11, 2016.
European Search Report for EP16169030 dated Dec. 16, 2016, dated Jan. 5, 2017.
European Search Report for application No. EP17175751 dated Aug. 25, 2017.
Japanese Office Action for application No. 2017-000038 dated Sep. 22, 2017.
International Search Report and Written Opinion for application No. PCT/US2017/036603 dated Oct. 18, 2017.
International Search Report and Written Opininon for application No. PCT/US2017/036606 dated Oct. 24, 2017.
International Search Report and Written Opinion for PCT/US18/14275 dated Apr. 4, 2018.
International Search Report and Written Opinion for PCT/US2018/020928 dated Jun. 7, 2018.
International Search Report and Written Opinion PCT/IB2019/052794 dated Jun. 19, 2019.
International Search Report and Written Opinion for PCT/US2019/038142 dated Aug. 2, 2019.
International Search Report and Written Opinion PCT/IB2019/052793 dated Nov. 11, 2019.
International Search Report and Written Opinion for PCT/US2019/049102 dated Dec. 2, 2019.
International Search Report and Written Opinion for PCT/US19/62696 dated Feb. 4, 2020.
U.S. Appl. No. 13/147,787, Aug. 27, 2014, Office Action.
U.S. Appl. No. 13/147,787, Apr. 17, 2015, Final Office Action.
U.S. Appl. No. 13/147,787, Sep. 30, 2015, Office Action.
U.S. Appl. No. 13/147,787, Feb. 16, 2016, Final Office Action.
U.S. Appl. No. 13/147,787, Oct. 28, 2016, Office Action.
U.S. Appl. No. 13/147,787, Mar. 7, 2017, Final Office Action.
U.S. Appl. No. 13/147,787, Jun. 26, 2017, Notice of Allowance.
U.S. Appl. No. 13/805,602, Dec. 2, 2015, Office Action.
U.S. Appl. No. 13/805,602, Mar. 21, 2016, Notice of Allowance.
U.S. Appl. No. 14/357,183, Jul. 16, 2015, Office Action.
U.S. Appl. No. 14/357,183, Nov. 12, 2015, Final Office Action.
U.S. Appl. No. 14/357,183, Jan. 29, 2016, Notice of Allowance.
U.S. Appl. No. 14/370,729, Jan. 26, 2017, Office Action.
U.S. Appl. No. 14/370,729, Jul. 12, 2017, Final Office Action.
U.S. Appl. No. 14/370,729, Dec. 19, 2017, Office Action.
U.S. Appl. No. 14/370,729, May 21, 2018, Notice of Allowance.
U.S. Appl. No. 14/357,190, Feb. 17, 2017, Office Action.
U.S. Appl. No. 14/357,190, Aug. 1, 2017, Final Office Action.
U.S. Appl. No. 14/357,190, Dec. 5, 2017, Notice of Allowance.
U.S. Appl. No. 14/357,190, Jan. 12, 2018, Notice of Allowance.
U.S. Appl. No. 29/419,922, Aug. 6, 2013, Office Action.
U.S. Appl. No. 29/419,922, Nov. 29, 2013, Notice of Allowance.
U.S. Appl. No. 15/901,089, Apr. 13, 2020, Office Action.
U.S. Appl. No. 14/970,224, May 30, 2018, Office Action.
U.S. Appl. No. 14/970,224, Aug. 13, 2018, Notice of Allowance.
U.S. Appl. No. 16/109,261, Apr. 28, 2020, Office Action.
U.S. Appl. No. 15/616,688, Mar. 19, 2020, Office Action.
U.S. Appl. No. 15/872,770, Mar. 27, 2020, Office Action.
International Search Report and Written Opinion received for PCT Patent Application No. PCT/IB20/052315, dated Aug. 24, 2020, 20 pages.

* cited by examiner

PACKAGING MACHINE AND SYSTEMS

CROSS-REFERENCE TO RELATED APPLICATIONS

This application claims priority to and the benefit of U.S. Patent Application Ser. No. 62/818,570, filed Mar. 14, 2019, entitled "Packaging Machine and Systems," the disclosure of which is incorporated herein by this reference.

BACKGROUND

1. The Technical Field

Exemplary embodiments of the disclosure relate to systems, methods, and devices for converting raw material into packaging templates.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks. For instance, previous systems have included cutting and creasing tools that require time-consuming movements and/or repositioning in order to make cuts and creases in the sheet material. As a result, the throughput of such machines has been limited.

Accordingly, it would be advantageous to have a packaging machine that can form box templates in a faster and more efficient manner.

BRIEF SUMMARY

Exemplary embodiments of the disclosure relate to systems, methods, and devices for forming packaging templates. For instance, one embodiment of a converting assembly is configured to perform a plurality of conversion functions on sheet material to convert the sheet material into packaging templates. The converting assembly includes a plurality of tool rollers. Each of the tool rollers has one or more conversion tools thereon. The one or more conversion tools on an individual tool roller are configured to perform a subset of the plurality of conversion functions that convert the sheet material into packaging templates.

According to another embodiment, a converting machine is configured to convert sheet material into packaging templates. The converting machine includes a feed changer configured to selectively feed sheet materials having different characteristics into the converting machine. The converting machine also includes a converting assembly that is configured to perform a plurality of conversion functions on the sheet material to convert the sheet material into packaging templates. The converting assembly includes at least first and second roller sets. The first roller set includes a first tool roller on a first axle. The first tool roller includes one or more transverse conversion tools thereon. The first tool roller is selectively rotatable on or about the first axle to selectively engage the one or more transverse conversion tools thereon with the sheet material. The second roller set includes at least first and second tool rollers on a second axle. Each of the first and second tool rollers on the second axle includes one or more transverse conversion tools and/or one or more longitudinal conversion tools thereon. The first and second tool rollers on the second axle are selectively rotatable on or about the second axle to selectively engage the one or more transverse conversion tools and/or the one or more longitudinal conversion tools thereon with the sheet material. The first and second tool rollers are selectively movable along a length of the second axle to reposition the one or more transverse conversion tools and/or the one or more longitudinal conversion tools relative to the sheet material. The movements of the first and second tool rollers may be symmetrical about a centerline of the converting assembly.

According to another embodiment, a method is provided for performing a plurality of conversion functions on sheet material to convert the sheet material into packaging templates. The method includes performing a first subset of conversion functions of the plurality of conversion functions on the sheet material with one or more tool rollers on a first axle. The method also includes performing a second subset of conversion functions of the plurality of conversion functions on the sheet material with one or more tool rollers on a second axle.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The embodiments described herein generally relate to systems, methods, and devices for forming packaging templates. While the present disclosure will be described in detail with reference to specific configurations, the descriptions are illustrative and are not to be construed as limiting the scope of the present disclosure. Various modifications can be made to the illustrated configurations without departing from the spirit and scope of the invention as defined by the claims. For better understanding, like components have been designated by like reference numbers throughout the various accompanying figures.

As used herein, the term "bale" shall refer to a stock of sheet material that is generally rigid in at least one direction, and may be used to make a box template. For example, the bale may be formed of a continuous sheet of material or a sheet of material of any specific length, such as corrugated cardboard and paperboard sheet materials. Additionally, the bale may have stock material that is substantially flat, folded, or wound onto a bobbin.

As used herein, the term "box template" shall refer to a substantially flat stock of material that can be folded into a box-like shape. A box template may have notches, cutouts, divides, and/or creases that allow the box template to be bent and/or folded into a box. Additionally, a box template may be made of any suitable material, generally known to those skilled in the art. For example, cardboard or corrugated paperboard may be used as the box template material. A suitable material also may have any thickness and weight that would permit it to be bent and/or folded into a box-like shape.

As used herein, the term "crease" shall refer to a line along which the box template may be folded. For example, a crease may be an indentation in the box template material, which may aid in folding portions of the box template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a divide through the template material is created.

Figure 1:
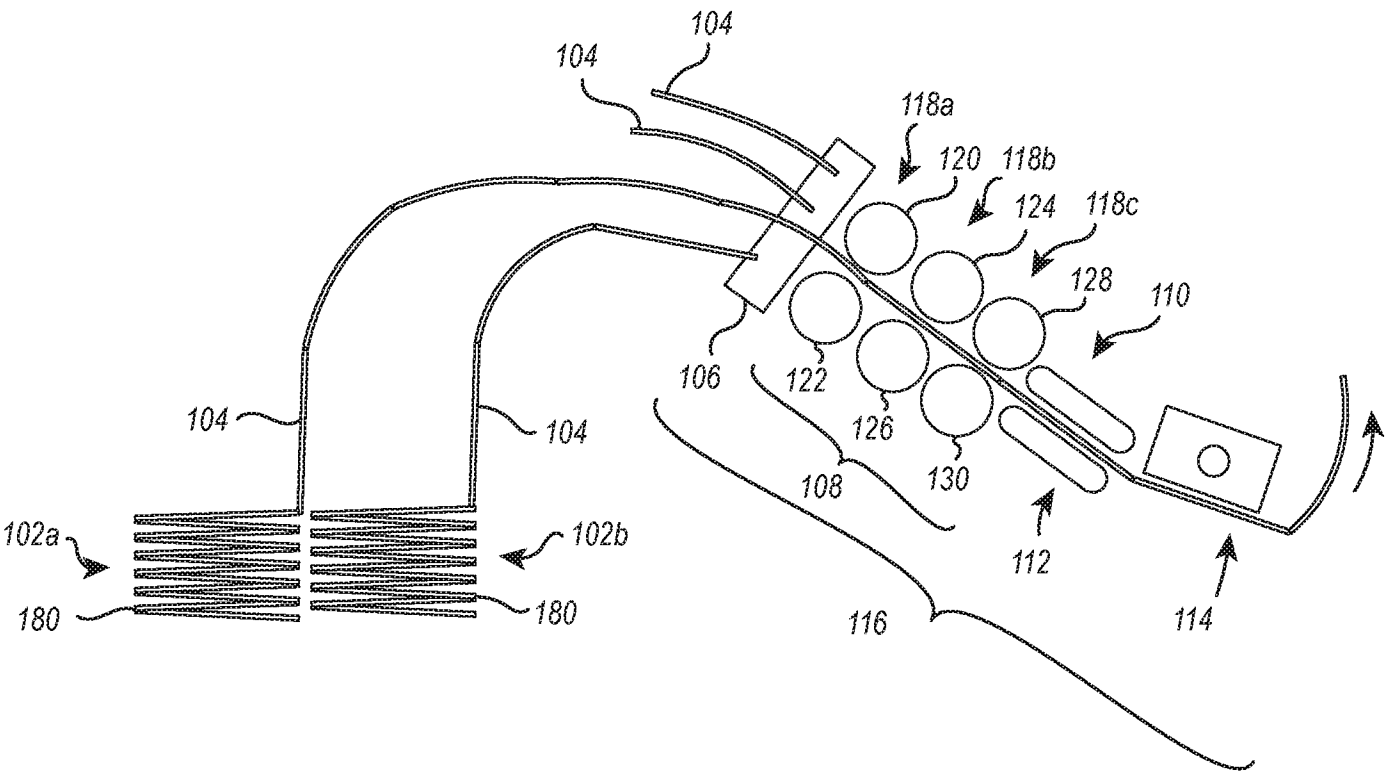
FIG. 1 illustrates a schematic view of an example system for forming packaging templates.

FIG. 1 illustrates an example system 100 that may be used to create packaging templates (and optionally erected boxes therefrom). The system 100 includes bales 102 (e.g., bales 102*a*, 102*b*) of sheet material 104. The system 100 also includes a feed changer 106 and a converting assembly 108. Optionally, the system 100 may also include a print assembly 110, a folding and attachment assembly 112, and/or an erecting assembly 114. Combinations of one or more of the feed changer 106, the converting assembly 108, the print assembly 110, the fold and attachment assembly 112, and/or the erecting assembly 114 may form a converting machine 116.

Generally, the feed changer 106 is configured to advance the sheet material 104 from a desired bale 102*a*, 102*b* into the converting assembly 108. The bales 102*a*, 102*b* may be formed of sheet material 104 that have different characteristics (e.g., widths, lengths, thickness, stiffness, color, etc.) from one another. For instance, the width of the bale 102*b* may be smaller than the width of the bale 102*a*. Thus, it may be desirable to use the sheet material 104 from the bale 102*b* to form a smaller box so there is less sheet material wasted (e.g., side trim).

Although FIG. 1 illustrates bales 102 of sheet material 104 being used as the source material from which packaging templates can be made, it will be appreciated that this is only exemplary. In other embodiments, the sheet material 104 may come from a source that is unfolded. For instance, the sheet material 104 may take the form of an endless or continuous sheet that has not been folded. As used herein, an endless or continuous sheet may simply refer to sheet material that is significantly longer than required to form a single packaging template or that is long enough to form multiple packaging templates therefrom. In other embodiments, the sheet material 104 may be formed by joining or splicing together individual panels or sheets of sheet material.

After the sheet material 104 passes through the feed changer 110, the sheet material 104 passes through the converting assembly 108, where one or more conversion functions are performed on the sheet material 104 to form a packaging template from the sheet material 104. The conversion functions may include cutting, creasing, bending, folding, perforating, and/or scoring the sheet material 104 in order to form a packaging template therefrom.

As the packaging template exits the converting assembly 108, the print assembly 110 may print labels, logos, instructions, or other material on the packaging template. The packaging template may also optionally be folded and glued by the folding and attachment assembly 112 (e.g., to form a manufacturer's joint). Furthermore, the erecting assembly 114 may also optionally erect the folded and glued packaging temple into an open box that is ready to be filled with product(s).

As can be seen in FIG. 1, the feed changer 106 can accept sheet material 104 from multiple bales 102. The position of at least a portion of the feed changer 106 can be adjusted relative to the converting assembly 108 such that the desired sheet material 104 is aligned with and can be fed into the converting assembly 108. For instance, the sheet material 104 from a particular bale 102 may be desired because of one or more characteristics of the sheet material (e.g., width, thickness, color, strength, etc.). The feed changer 106 may be adjusted so that the desired sheet material 104 from the appropriate bale 102 is positioned to be fed into the converting assembly 108. In FIG. 1, for instance, the feed changer 106 is adjusted to feed sheet material 104 from the bale 102*a* into the converting assembly 108.

In some embodiments, the feed changer 106 is configured to adjust on the fly. For instance, the feed changer 106 may be configured to change which sheet material 104 is fed into the converting assembly 108 even while the converting assembly 108 completes the conversion functions on a previous packaging template.

As the sheet material 104 advances through the converting assembly 108, one or more converting tools (discussed in greater detail below) perform conversion functions (e.g., crease, bend, fold, perforate, cut, score) on the sheet material 104 in order to create packaging templates out of the sheet material 104. Some of the conversion functions may be made on the sheet material 104 in a direction substantially perpendicular to the direction of movement and/or the length of the sheet material 104. In other words, some conversion functions may be made across (e.g., between the sides) the sheet material 104. Such conversion functions s may be considered "transverse conversions" or "transverse conversion functions." In contrast, some of the conversion functions may be made on the sheet material 104 in a direction substantially parallel to the direction of movement and/or the length of the sheet material 104. Such conversions may be considered "longitudinal conversions" or "longitudinal conversion functions." The converting assembly 108 may also or alternatively perform one or more angled and/or curved conversion functions on the sheet material 104. Such angled and/or curved conversion functions may extend at least partially along the length of the sheet material and at least partially between opposing side edges thereof. Furthermore, some of the conversion functions may include cutting excess material off of the sheet material 104. For instance, if the sheet material 104 is wider than needed to form a desired packaging template, part of the width of the sheet material 104 can be cut off by one or more conversion tools.

In the embodiment illustrated in FIG. 1, the converting assembly 108 includes a series of roller sets 118 (e.g., roller sets 118*a*, 118*b*, 118*c*). Each roller set 118 may include one or more converting tools for performing the conversion functions on the sheet material 104. For instance, in some embodiments, roller set 118*a* may include one or more conversion tools that are configured to make cuts and/or creases along all or portions of the width of the sheet material 104. Similarly, in some embodiments, roller set 118*b* may include one or more conversion tools that are configured to make cuts and/or creases along all or portions of the length of the sheet material 104. Likewise, in some embodiments, roller set 118*c* may include one or more conversion tools for making transverse and/or longitudinal cuts (e.g., to form flaps of the packaging template).

In some embodiments, each roller set 118 may include one or more rollers that include the conversion tools (referred to herein as tool rollers) and one or more opposing rollers (referred to herein as support rollers) opposite thereto. For instance, FIG. 1 illustrates roller set 118*a* with a tool roller 120 and a support roller 122, roller set 118*b* with a tool roller 124 and a support roller 126, and roller set 118*c* with a tool roller 128 and support roller 130.

In the illustrated embodiment, the tool rollers 120, 124, 128 are disposed on one side (e.g., above) of the sheet material 104 and the support rollers 122, 126, 130 are disposed on an opposite side (e.g., below) of the sheet material 104. In other embodiments, the tool rollers 120, 124, 128 may be positioned below the sheet material 104 and the support rollers 122, 126, 130 may be position above the sheet material 104. In still other embodiments, some of the tool rollers 120, 124, 128 may be positioned above the sheet material 104 and some of the tool rollers 120, 124, 128 may be positioned below the sheet material 104. In such embodiments, some of the support rollers 122, 126, 130 may be positioned above the sheet material 104 and some of the support rollers 122, 126, 130 may be positioned below the sheet material 104. In still other embodiments, at least one of the tool rollers 120, 124, 128 may be positioned above the sheet material 104 and at least one of the tool rollers 120, 124, 128 may be positioned below the sheet material 104 and generally opposite to the tool roller that is above the sheet material 104. In such embodiment, the opposing tool rollers may both perform conversion functions on the sheet material and act as a support roller for the opposing tool roller (e.g., the top tool roller may act as a support roller for the bottom tool roller and the bottom tool roller may act as a support roller for the top tool roller).

As used herein, relative positional terms, such as "top," "bottom," "above," and "below," are merely used for convenience. In at least some embodiments, such terms should be understood to mean that the referenced element is positioned to one side or another of another element. For example, as noted above, some of the tool rollers 120, 124, 128 and the support rollers 122, 126, 130 can be positioned on one side or another of the sheet material 104. In some embodiments, some of the tool rollers 120, 124, 128 and/or the support rollers 122, 126, 130 may actually be positioned above or below the sheet material 104. In other embodiments, however, some of the tool rollers 120, 124, 128 and/or the support rollers 122, 126, 130 may merely be positioned to one side or another of the sheet material. Thus, reference herein to tool rollers and/or support rollers as being "top" or "bottom" rollers or positioned "above" or "below" the sheet material is intended to broadly cover the tool rollers and/or support rollers being positioned to one side or another of the sheet material, regardless of whether the sheet material is oriented horizontally, vertically, or angled (e.g., such as shown in FIG. 1).

In some embodiments, each of the tool rollers in a given roller set 118 may be mounted on a common axle and/or along a common axis. Similarly, in some embodiments, each of the support roller in a given roller set 118 may be mounted on a common axle and/or along a common axis. The support rollers may provide a support surface for the sheet material 104 as the tool rollers perform the conversion functions thereon. In some embodiments, the rotation of the support rollers (and optionally the tool rollers) may also assist with advancing the sheet material 104 through the converting assembly 108.

Figure 2A:
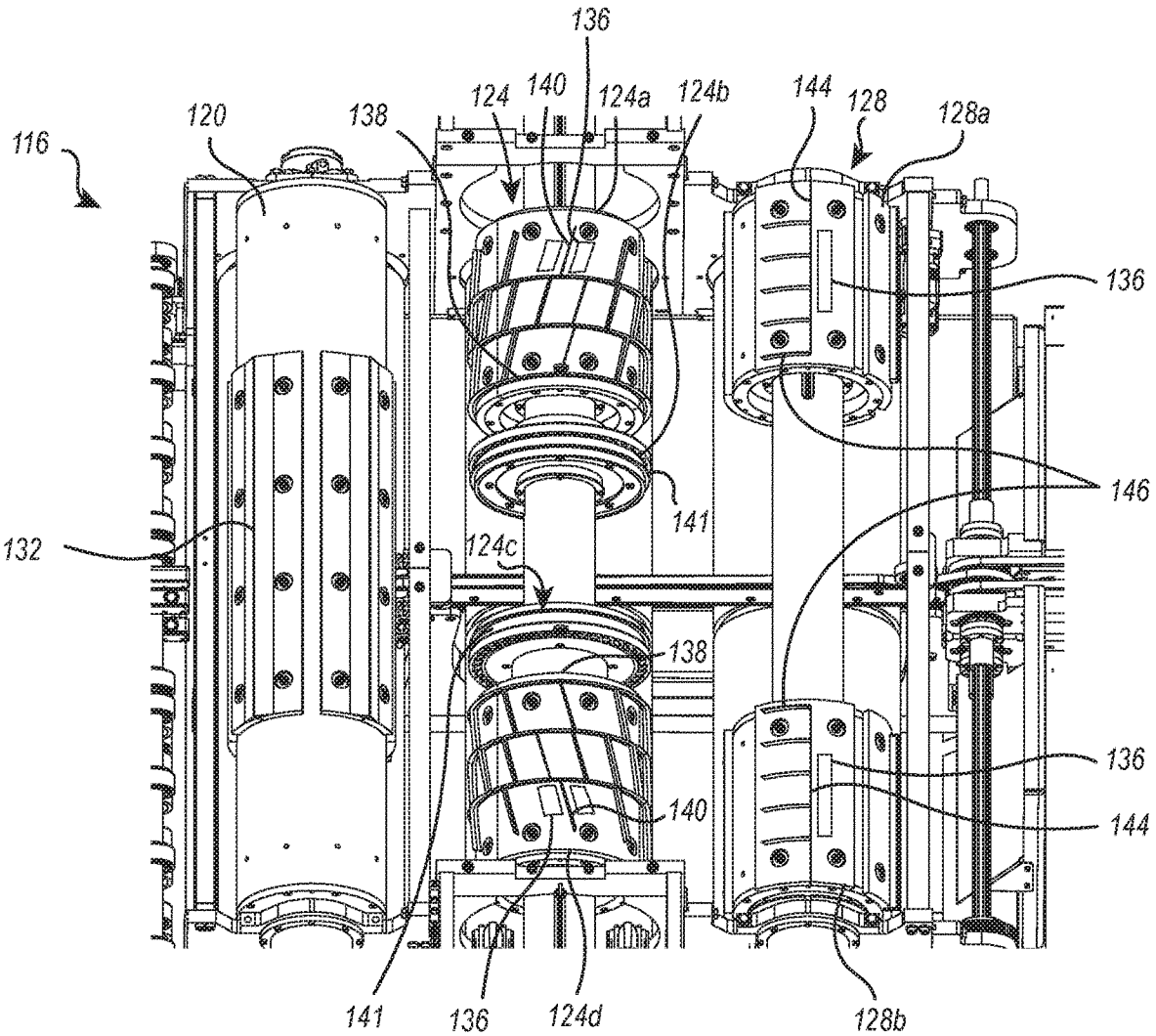
FIGS. 2A-2C illustrate an example converting assembly for converting sheet material into packaging templates.
Figure 2B:
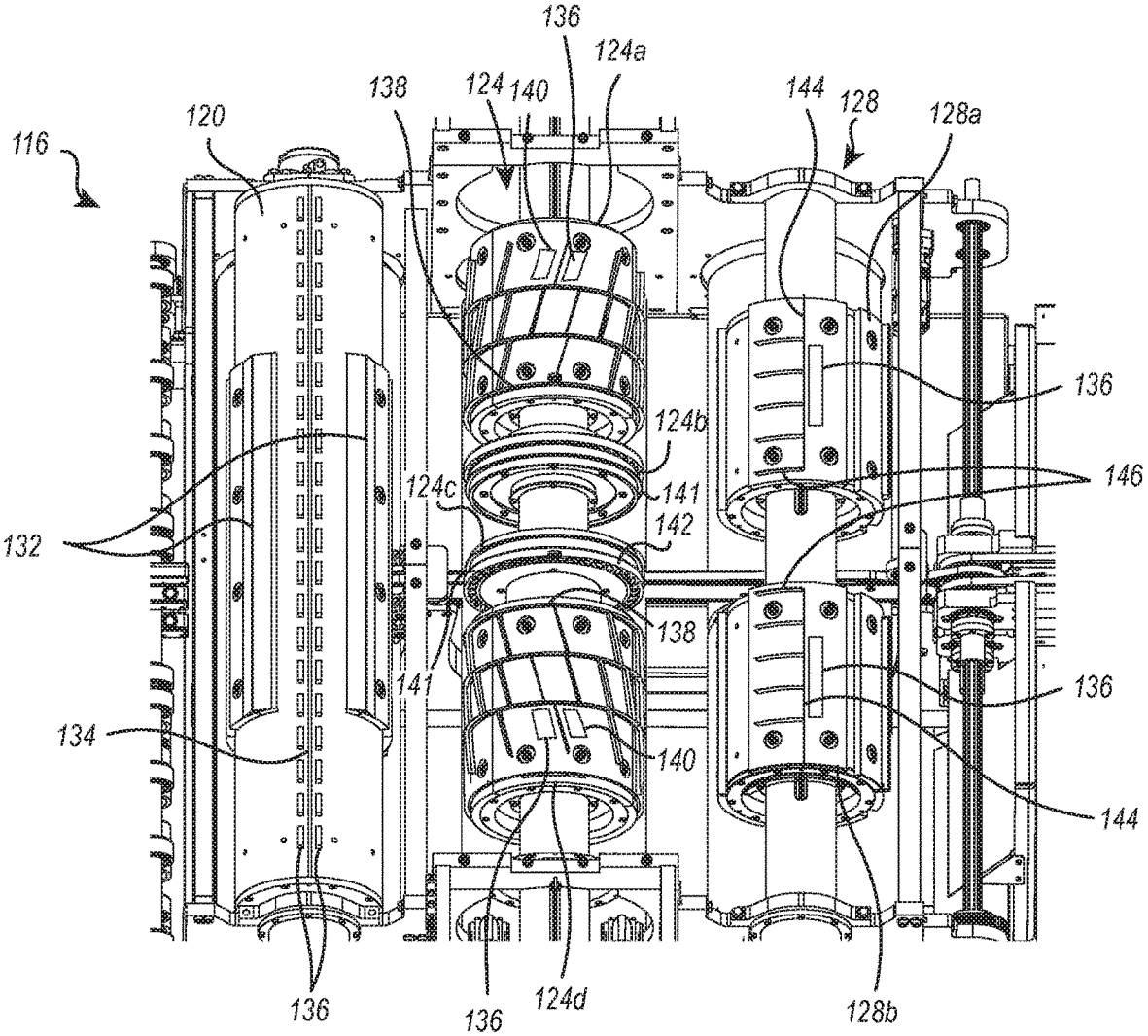

Attention is now directed to FIGS. 2A and 2B, which illustrate an example embodiment of the converting assembly 116. More particularly, FIGS. 2A and 2B primarily illustrate example embodiments of the tool rollers 120, 124, 128 of the converting assembly 116. While FIGS. 2A and 2B illustrate a particular configuration of the tool rollers 120, 124, 128, it will be appreciated that the illustrated and described embodiment is merely exemplary and the tool rollers may be rearranged, fewer or more tool rollers may be used, and/or the conversion tools thereof may be rearranged or redistributed among the rollers 120, 124, 128 or fewer or more tool rollers.

In the illustrated embodiment, the tool roller 120 is mounted on a first axle or about a first axis to enable the tool roller 120 to rotate thereabout. The tool roller 120 may include one or more creasing tools 132 disposed thereon. As seen in FIGS. 2A and 2B, the creasing tool(s) 132 may be a ridge or projection formed on or extending radially from the outer surface of the tool roller 120. When the tool roller 120 is rotated so that a creasing tool 132 engages the sheet material 104, the creasing tool 132 can form a crease in the sheet material 104. More specifically, the creasing tool 132 may cooperate with the support roller 122 (FIG. 1) to compress or make an indentation in the sheet material 104, thereby forming a crease in the sheet material 104.

In some embodiments, the creasing tool(s) 132 may be permanently attached or integrated into the tool roller 120. In other embodiments, the creasing tool(s) 132 may be selectively attachable to or removable from the tool roller 120. In the illustrated embodiment, the creasing tool(s) 132 extend along at least a portion of the length of tool roller 120. In some embodiment, one or more of the creasing tools 132 may extend continuously along a least a portion of the length of tool roller 120. In other embodiments, one or more of the creasing tools 132 may extend discontinuously along a least a portion of the length of tool roller 120 (e.g., such that there are gaps between portions of the creasing tool 132). The one or more creasing tools 132 may be disposed at one or more distinct locations about the circumference of the tool roller 120. In some embodiments, one or more of the creasing tools 132 may extend at least partially around the circumference of the tool roller 120.

As can be seen in FIG. 2B, the tool roller 120 may also include one or more separation knives 134. The separation knife 134 illustrated in FIG. 2B may be a knife or blade formed on or extending radially from the outer surface of the tool roller 120. When the tool roller 120 is rotated so that the separation knife 134 engages the sheet material 104, the separation knife 134 can form a cut in the sheet material 104. In some embodiments, at least one separation knife 134 extends along all or a substantial portion of the width of the converting assembly 108. As such, the separation knife 134 can be configured to form a cut along the entire width of the sheet material 104 in order to separate the sheet material 104 into separate pieces. Once such a separation cut is made, the feed changer 106 may change what sheet material 104 will be fed into the converting assembly 108 next.

In some embodiments, the tool roller 120 may include one or more resilient members adjacent to the creasing tool(s) 132 and/or the separation knife(ves) 134. For instance, as shown in FIG. 2B, the tool roller 120 includes resilient members 136 on opposing sides of the separation knife 134. In the illustrated embodiment, the resilient members 136 include a plurality of resilient members 136 disposed along opposing sides of the separation knife 134. In other embodiments, the tool roller 120 may include one or more resilient members 136 on a single side of the separation knife 134, one or more resilient members 136 on each side of the separation knife 134, or a single resilient member 136 on one side of the separation knife 134 and a plurality of resilient members 136 on an opposing side thereof. Likewise, the one or more resilient members 136 may be disposed on one or both sides of one or more of the creasing tool(s) 132.

The resilient member(s) 136 may be formed of rubber, foam, or other materials or devices (e.g., springs) that can be compressed and then expand back to an original size. The resilient member(s) 136 can provide various functionalities to the tool roller 120. For instance, the resilient member(s) 136 can be compressed between the tool roller 120 and the sheet material 104 when a creasing tool 132 or a separation knife 134 is rotated to engage the sheet material 104. As the tool roller 120 rotates to disengage the creasing tool 132 or the separation knife 134 from the sheet material 104, the expansion of the resilient member 136 can assist with withdrawing the creasing tool 132 or the separation knife 134 from the sheet material 104. The resilient member(s) 136 may also engage the sheet material 104 during rotation of the tool roller 120 to assist with advancing the sheet material 104 through the converting assembly 108.

With continued attention to FIGS. 2A and 2B, attention is now to directed to tool roller 124. In the illustrated embodiment, the tool roller 124 is formed of four tool rollers 124*a*, 124*b*, 124*c*, 124*d* which are mounted on a second axle or about a second axis. In the illustrated embodiment, the second axle or second axis is substantially parallel to the first axle or first axis.

The tool rollers 124*a*, 124*b*, 124*c*, 124*d* include one or more conversion tools that can be used to perform one or more conversion functions on the sheet material 104. For instance, the tool rollers 124*a* and 124*d* each include a side trim knife 138. In some embodiments, the side trim knives 138 extend around all or a substantial portion of the circumferences of the tool rollers 124*a*, 124*d* and radially therefrom. The side trim knives 138 may be oriented perpendicular to the second axle or axis and generally parallel to the length of the sheet material 104. In this configuration, the side trim knives 138 are configured to trim off the sides of the sheet material 104 when the sheet material 104 is wider than necessary to form a desired packaging template. In some embodiments, the side trim knives 138 can continuously engage the sheet material 104 if the sheet material 104 is wider than necessary to make a desired packaging template. In other embodiments, if the sheet material 104 is already the proper width to make a desired packaging template, the side trim knives 138 may not engage the sheet material 104.

The tool rollers 124*a*, 124*d* may also include one or more additional knives 140, as shown in FIGS. 2A and 2B. The knives 140 may be configured to cut the side trim from the sheet material 104 into smaller pieces. In some embodiments, the knives 140 extend primarily parallel to the second axle or axis. However, as can be seen in FIGS. 2A and 2B, the knives 140 can extend at least partially around the circumference of the tool rollers 124*a*, 124*d*. Thus, the knives 140 can be angled or perpendicular to the second axle or axis. In addition to side trim knives 140, some embodiments may include one or more trim attraction elements for attracting the pieces of side trim. In some embodiments, the one or more trim attraction elements may include one or more blowers, fans, vacuums, or static generation elements that can attract or direct the side trim to a desired area.

Similar to the tool roller 120, the tool rollers 124*a*, 124*d* may include one or more resilient members 136 disposed on one or more sides of the conversion tools, including the side trim knives 138 and the knives 140.

The tool rollers 124*b*, 124*c* may include creasing tools 141 for forming longitudinal creases in the sheet material 104. The creasing tools 141 may include ridges or other projections that extend radially out from the tool rollers 124*b*, 124*c*. In some embodiments, the creasing tools 141 may extend around all or substantially all of the circumferences of the tool rollers 124*b*, 124*c*. The creasing tools 141 on the tool rollers 124*b*, 124*c* may form creases in the sheet material 104 that will define boundaries between side wall panels and top and bottom flaps of the packaging template being formed.

In some embodiments, the tool rollers 124*a*-124*d* may rotate about the second axle or axis to cause the conversion tools thereon to engage or disengage the sheet material 104. Additionally, in some embodiments, the tool rollers 124*a*-124*d* may also move along the length of the second axle or axis either closer to or further away from one another. For instance, the tool rollers 124*a*, 124*d* are spaced further apart from one another in FIG. 2A than in FIG. 2B. The spacing between tool rollers 124*a*, 124*d* can be determined by the width of the packaging template being formed. For instance, the tool rollers 124*a*, 124*d* may be spaced apart from one another such that the distance between their respective side trim knives 138 is equal to the desired width of the packaging template being formed.

Similarly, the tool rollers 124*b*, 124*c* may also be moved closer together or further apart, as can be ascertained from a comparison between FIGS. 2A and 2B. The tool rollers 124*b*, 124*c* can be spaced apart so that the distance between their respective creasing tools is equal to a desired dimension of the packaging template (e.g., height of the side walls).

Furthermore, the tool rollers 124*a*, 124*b* can be spaced apart from one another by a desired dimension. Likewise, the tool rollers 124*c*, 124*d* can also be spaced apart from one another by a desired dimension. In some embodiments, the dimensions between the tool rollers 124*a*, 124*b* and between the tool rollers 124*c*, 124*d* can be equal to one another. In some embodiments, the distance between the tool rollers 124*a*, 124*b* and between the tool rollers 124*c*, 124*d* can be equal to a desired dimension of packaging template flaps.

In some embodiments, the tool rollers 124*a*, 124*d* may move symmetrically along the length of the second axle or axis. For instance, as the tool roller 124*a* moves towards a first end of the second axle or axis, the tool roller 124*d* can move in an opposite direction towards a second end of the second axle or axis. Likewise, as the tool roller 124*a* moves towards a longitudinal center of the second axle or axis, the tool roller 124*d* can likewise move in an opposite direction towards the longitudinal center of the second axle or axis. As a result, the tool rollers 124*a*, 124*d* can always be positioned an equal distance from the longitudinal center of the second axle or axis. In the same manner, tool rollers 124*b*, 124*c* may also be symmetrically mounted and movable on the second axle or axis such that the tool rollers 124*b*, 124*c* can always be positioned an equal distance from the longitudinal center of the second axle or axis.

In some embodiments, the tool roller 124 may also include one or more feed rollers 142 mounted on the second axle or about the second axis. The one or more feed rollers may rotate about the second axle or axis and engage the sheet material 104 to assist with advancing sheet material 104 through the converting assembly 108.

In some embodiments, the rotation of the second axle and/or the tool rollers 124*a*, 124*b*, 124*c*, 124*d* and the feed roller 142 may be actively driven (e.g., via one or more motors). In other embodiments, the second axle may freely rotate and/or the tool rollers 124*a*, 124*b*, 124*c*, 124*d* and the feed roller 142 may freely rotate about the second axle or axis. For instance, the second axle and/or the tool rollers 124*a*, 124*b*, 124*c*, 124*d* and the feed roller 142 may not be actively and directly driven (e.g., with one or more motors). Rather, the support roller 126 (see FIG. 1) associated with the second axle or axis may be actively driven (e.g., with a motor). Rotation of the support roller 126 and/or the movement of the sheet material 104 between the support roller 126 and tool rollers on the second axle may result in rotation of the tools and/or roller(s) on the second axle.

In some embodiments, the conversion tools on the second axle may engage and/or penetrate into the associated support roller 126. In order to reposition the tool rollers 124*a*, 124*b*, 124*c*, 124*d* along the length of the second axle or axis, the conversion tools thereon may first need to be disengaged from the support roller 126. This may be accomplished by moving the second axle away from the support roller 126, moving the support roller 126 away from the second axle, or a combination thereof via one or more actuators. Alternatively, or additionally, the tool rollers 124*a*, 124*b*, 124*c*, 124*d* may be rotated so as to rotate the conversion tools away from the support roller 126, thereby disengaging the conversion tools from the support roller 126.

Once the conversion tools are disengaged from the support roller 126, the tool rollers 124*a*, 124*b*, 124*c*, 124*d* can be repositioned along the length of the second axle or axis and the conversion tools can be reengaged with the support roller 126 (e.g., by moving the second axle towards the support roller 126, moving the support roller 126 towards the second axle, rotating the tool rollers 124*a*, 124*b*, 124*c*, 124*d* so the conversion tools engage the support roller 126, or a combination thereof).

With continuing reference to FIGS. 2A, 2B, attention is now directed to the tool roller 128. In the illustrated embodiment, tool roller 128 includes tool rollers 128*a*, 128*b* mounted on a third axle or about a third axis. In the illustrated embodiment, the third axle or axis is substantially parallel to the first and second axles or axis.

The tool rollers 128*a*, 128*b* include one or more conversion tools that can be used to perform one or more conversion functions on the sheet material 104. For instance, tool rollers 128*a* and 128*b* each include one or more flap knives 144. The one or more flap knives 144 illustrated in FIGS. 2A and 2B may be knives or blades formed on or extending radially from the outer surface of the tool rollers 128*a*, 128*b*. The one or more flap knives 144 may extend generally parallel to the third axle or axis.

When the tool rollers 128*a*, 128*b* are rotated so that the flap knives 144 engage the sheet material 104, the flap knives 144 can form cuts or notches in the sheet material 104. The cuts or notches formed by the flap knives 144 may at least partially define flaps of the packaging template. In some embodiments, the flap knives 144 extends along all or a substantial portion of the width of the tool rollers 128*a*, 128*b*.

Figure 2C:
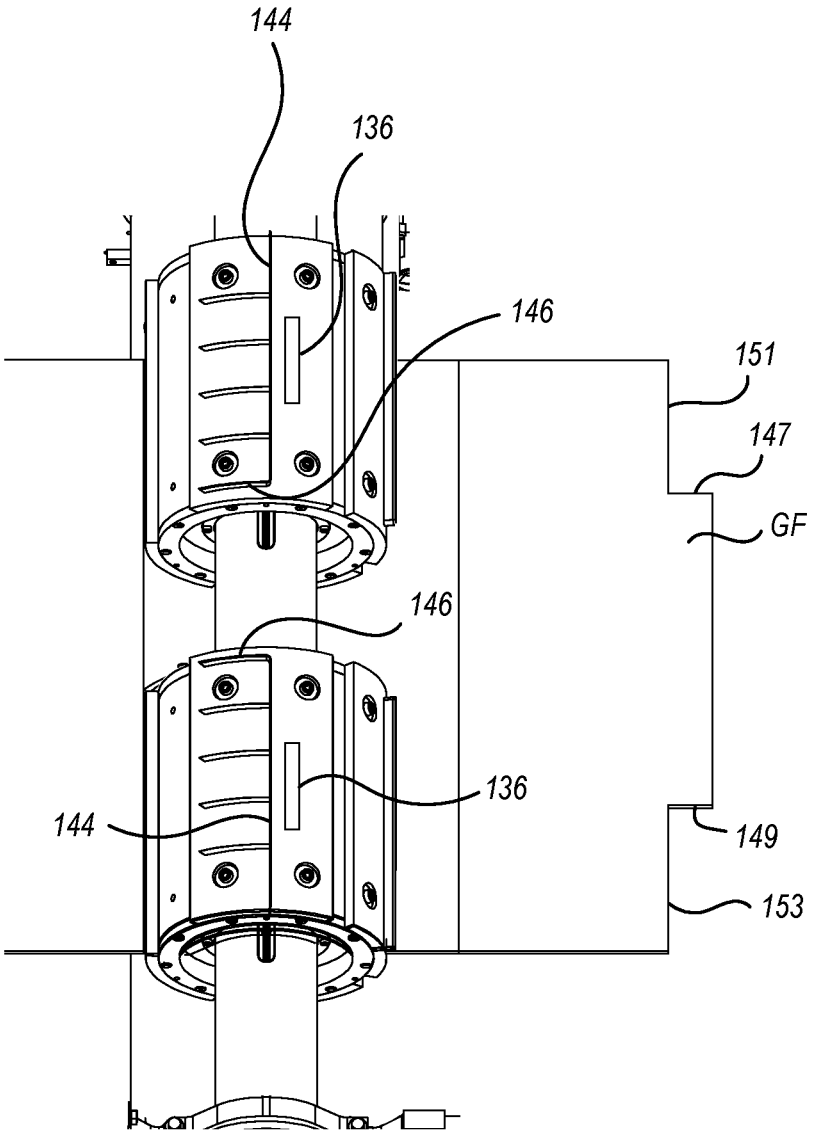

In some embodiments, the tool rollers 128*a*, 128*b* may also include longitudinal knives 146. The longitudinal knives 146 may be oriented generally perpendicular to the third axle or axis and parallel to the length or feed direction of the sheet material 104. In some embodiments, the longitudinal knives 146 may extend around all or a portion of the circumferences of the tool rollers 128*a*, 128*b*. The longitudinal knives 146 may be rotated into engagement with the sheet material 104 to cut off portions of the sheet material 104. For instance, the longitudinal knives 146 may cut off portions of the sheet material 104 adjacent to a glue flap formed therein as part of the packaging template. For instance, as shown in FIG. 2C, the longitudinal knives 146 can be rotated to engage the sheet material 104 and form longitudinal cuts at edges 147, 149. The cuts at edges 147, 149 along with the cuts at edges 151, 153 (formed by flap knives 144) cut out excess sheet material on opposing sides of the glue flap GF.

Similar to the tool rollers 120 and 124, the tool rollers 128*a*, 128*b* may include one or more resilient members 136 disposed on one or more sides of the conversion tools, including the flap knives 144 and the longitudinal knives 146. Furthermore, like the tool rollers 120 and 124*a*-124*d*, the tool rollers 128*a*, 128*b* may rotate about the third axle or axis to cause the conversion tools thereon to engage or disengage the sheet material 104. Additionally, like the tool rollers 124*a*-124*d*, the tool rollers 128*a* 128*b* may also move symmetrically along the length of the third axle or axis either closer to or further away from one another. For instance, the tool rollers 128*a*, 128*b* are spaced further apart from one another in FIG. 2A than in FIG. 2B. The spacing between tool rollers 128*a*, 128*b* can be determined by the width of the packaging template being formed. For instance, the longitudinal knives 146 may be generally aligned with the creasing tools on the tool rollers 124*b*, 124*c*. Additionally, the ends of the flaps knives 144 closest to the longitudinal center of the third axle or axis may be spaced apart from one another such that the distance between the noted ends is equal to a desired dimension (e.g., height of the packaging template side walls) of the packaging template being formed.

In some embodiments, the tool rollers 128*a*, 128*b* may move symmetrically along the length of the third axle or axis. For instance, as the tool roller 128*a* moves towards a first end of the third axle or axis, the tool roller 128*b* can move in an opposite direction towards a second end of the third axle or axis. Likewise, as the tool roller 128*a* moves towards a longitudinal center of the third axle or axis, the tool roller 128*b* can likewise move towards the longitudinal center of the third axle or axis. As a result, the tool rollers 128*a*, 128*b* can always be positioned an equal distance from the longitudinal center of the third axle or axis.

In some embodiments, the rotation of the third axle and/or the tool rollers 128*a*, 128*b* about the third axis may be actively driven (e.g., via a motor) or freely rotate (similar to the second axle and the tool rollers thereon). In other embodiments, the conversion tools on the tool rollers 128*a*, 128*b* may be disengage from the support roller 130 (see FIG. 1) by moving the third axle away from the support roller 130, moving the support roller 130 away from the third axle, or a combination thereof via one or more actuators. Such disengagement of the conversion tools may enable the tool rollers 128*a*, 128*b* to be repositioned along the length of the third axle and the conversion tools can be reengaged with the support roller 130 (e.g., by moving the third axle towards the support roller 130, moving the support roller 130 towards the third axle, or a combination thereof).

Figure 3:
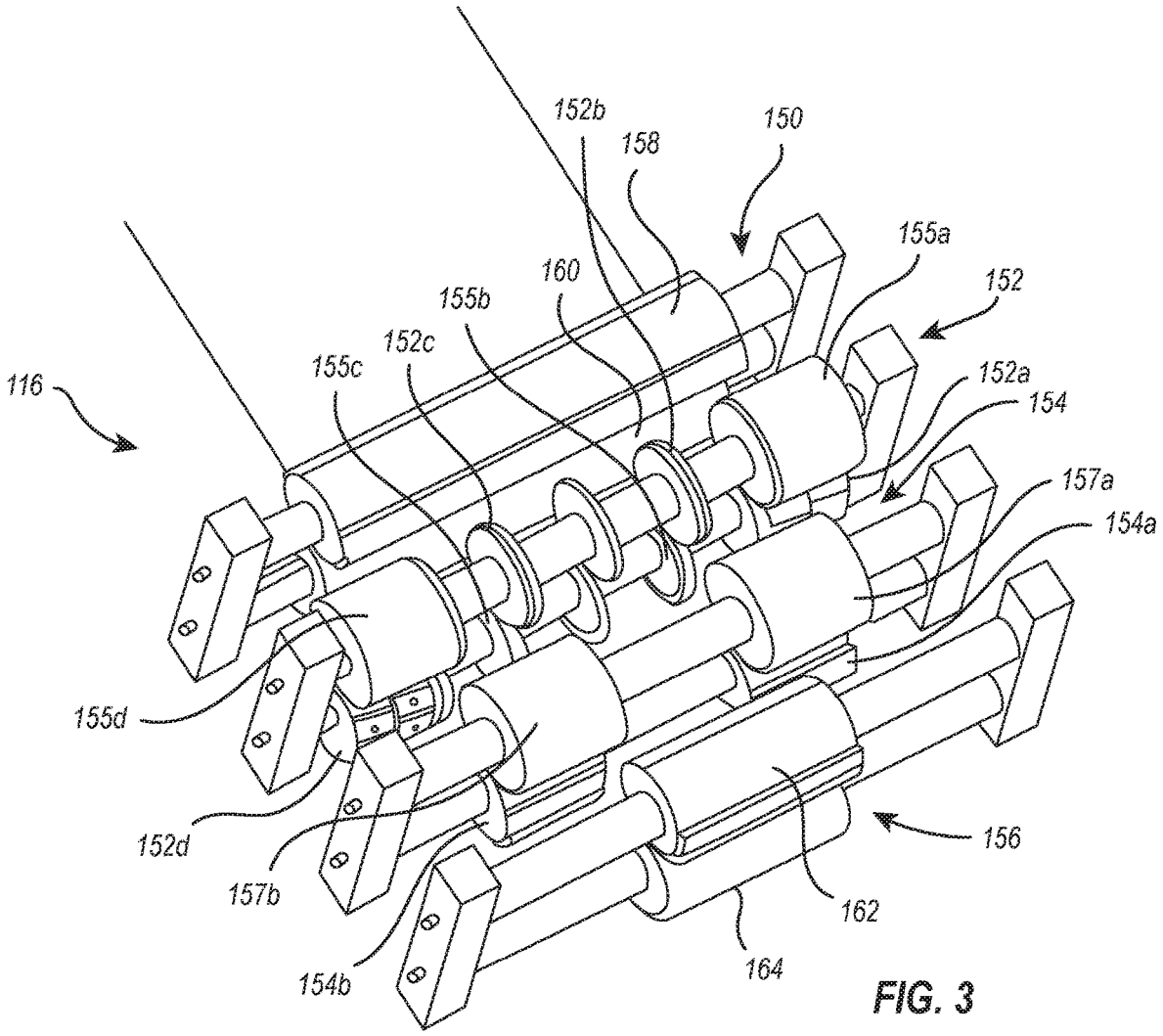
FIG. 3 illustrates another example converting assembly for converting sheet material into packaging templates.

As noted above, the number of roller sets, tool rollers, and support rollers, as well as the ordering thereof and the configuration of the conversion tools thereon can be altered from one embodiment to another. By way of example, FIG. 3 illustrates another embodiment of a converting assembly 116. Many aspects of the embodiment illustrated in FIG. 3 may be similar or identical to the embodiment shown and described in connection with FIGS. 2A and 2B. According, the following description of FIG. 3 will focus primarily on the aspects that are different from the embodiment of FIGS. 2A and 2B.

As can be seen in FIG. 3, the converting assembly 116 includes a plurality of roller sets. Each roller set includes one or more tool rollers and one or more support rollers. Unlike the converting assembly of FIGS. 2A and 2B, which included three roller sets, the converting assembly of FIG. 3 includes four roller sets, namely roller sets 150, 152, 154, 156.

The roller set 150 may include a tool roller 158 and a support roller 160. The tool roller 158 may include one or more separation knives and/or resilient members, similar or identical to tool roller 120 of FIGS. 2A and 2B. Unlike tool roller 120, however, tool roller 158 does not include transverse creasing tools in the illustrated embodiment. Rather, roller set 156 includes a tool roller 162 that includes one or more transverse creasing tools, similar to the creasing tools 132 on tool roller 120. Roller set 156 also includes a support roller 164.

Roller sets 152 is substantially similar to the previously described roller set that includes tool rollers 124. For instance, the roller set 152 has similar tool rollers (and associated conversion tools) as tool roller 124. In contrast, however, the arrangement of the tool rollers and support rollers in FIG. 3 is distinct from that of FIGS. 2A and 2B. By way of example, roller set 152 includes tool rollers 152*a*, 152*b*, 152*c*, 152*d*. Rather than having a single support roller for all of the tool rollers 152*a*, 152*b*, 152*c*, 152*d*, roller set 152 includes individual support rollers 155*a*, 155*b*, 155*c*, 155*d* that correspond to tool rollers 152*a*, 152*b*, 152*c*, 152*d*.

Additionally, the positioning of the tool rollers 152*a*, 152*b*, 152*c*, 152*d* and the support rollers 155*a*, 155*b*, 155*c*, 155*d* is unique compared to the embodiment shown in FIGS. 2A and 2B. For instance, rather than having the tool rollers and the support rollers positioned on opposite side of the sheet material, some of the tool rollers 152*a*, 152*b*, 152*c*, 152*d* are positioned to be on one side of the sheet material and some are positioned to be on an opposite side thereof. Similarly, some of the support rollers 155*a*, 155*b*, 155*c*, 155*d* are positioned to be on one side of the sheet material and some are positioned to be on an opposite side thereof.

The roller set 154 is substantially similar to the previously described roller set that includes tool roller 128. For instance, the roller set 154 has similar tool rollers (and associated conversion tools) as tool roller 128. In contrast, however, the arrangement of the tool rollers and support rollers in FIG. 3 is distinct from that of FIGS. 2A and 2B. More particularly, FIG. 3 illustrates tool rollers 154*a*, 154*b* being positioned so as to be below the sheet material and the support rollers 157*a*, 157*b* being positioned so as to be above the sheet material as the sheet material is advanced through the converting assembly 116. In contrast, the tool roller 128 from FIGS. 2A and 2B are positioned to be above the sheet material and the associated support roller(s) below the sheet material.

As noted elsewhere herein, relative positional terms, such as "above" and "below," are used merely for convenience and should not be limiting. Rather, "above" and "below" are used to simply refer to one element being positioned to one side or another of another element. Thus, for example, although the tool rollers 154*a*, 154*b* and the support rollers 157*a*, 157*b* are described as being positioned respectively "below" and "above" the sheet material, the machine may be inverted so that the tool rollers 154*a*, 154*b* and the support rollers 157*a*, 157*b* are positioned respectively "above" and "below" the sheet material. Generally, an element may be considered "above" or "below" a reference element (e.g., the sheet material) as long as the element is positioned to one side or another of the reference element, regardless of the orientation of the reference element (e.g., horizontal, vertical, diagonal, etc.).

Figure 4:
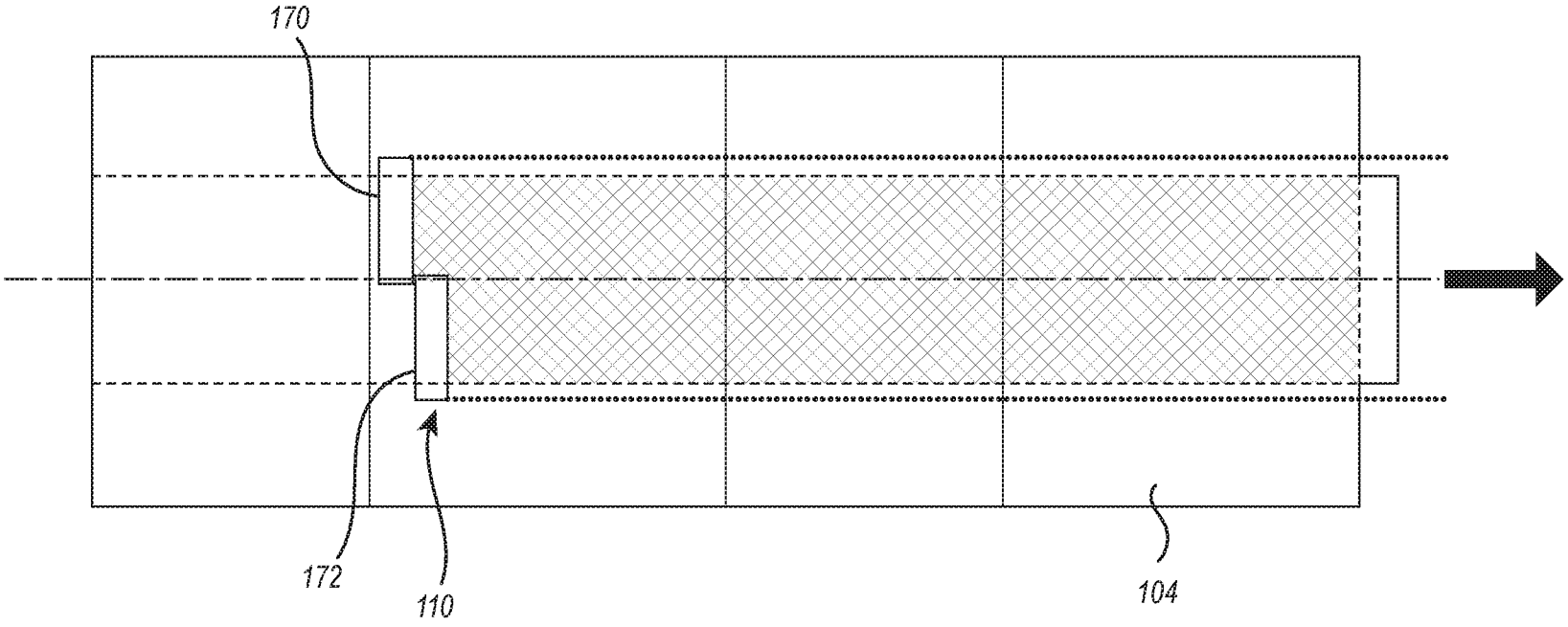
FIG. 4 illustrates an example printing arrangement for printing on packaging templates.

As noted above, in addition to performing conversion functions of the sheet material to create packaging templates, the converting machine 116 may optionally include a print assembly 110 for printing on packaging templates, as shown in FIGS. 1 and 4. As shown in FIG. 4, the print assembly 110 may include print heads 170, 172 (although a single print head or more than two print heads are contemplated herein).

In the illustrated embodiment, the prints heads 170, 172 are offset from one another in the feed direction of the sheet material 104. As a result, the sheet material 104 will begin passing print head 170 before the sheet material 104 begins passing print head 172. As can be seen in FIG. 4, the print heads 170, 172 are arranged so that as a set the print heads 170, 172 are centered with the sheet material 104. As a result, the print heads 170, 172 can, if desired, print on the sheet material 104 so that the printing is centered on the sheet material 104.

In some embodiments, the print heads 170, 172 can be movable relative to one another and the sheet material 104. For instances, the print heads 170, 172 may move closer to or further away from one another. In some embodiments, the movements of the print heads 170, 172 may be symmetrical about the centerline of the machine and/or the sheet material 104 (similar to the symmetrical movements of the tool rollers described above). Such symmetrical movement may allow the print heads 170, 172 to adjust for the size of packaging template that is being printed on. For instance, the print heads 170, 172 may move further apart to print on a larger packaging template and may move closer together to print on a smaller packaging temple. The offset positioning of the print heads 170, 172 may allow the print heads 170, 172 to move even closer together, even partially overlapping as shown in FIG. 4.

Attention is returned briefly to FIG. 1. As noted above, the sheet material 104 may be arranged into bales 102. To form a bale 102 with the sheet material 104, the sheet material 104 is, in this embodiment, folded back and forth on itself. Due to this folding pattern, the bales 102 are sometimes referred to as z-fold or fanfold bales. When forming a bale 102, fanfold creases 180 are formed in the sheet material 104. When the sheet material 104 is taken from the bale 102, the fanfold creases 180 are unfolded. Unfortunately, however, the fanfold creases 180 can try to refold the sheet material 104, which can cause problems when the sheet material 104 is advanced through the converting machine 116. For instance, folding of the sheet material 104 at the fanfold creases 180 can cause the sheet material 104 to become jammed in the converting machine 116.

Figure 5A:
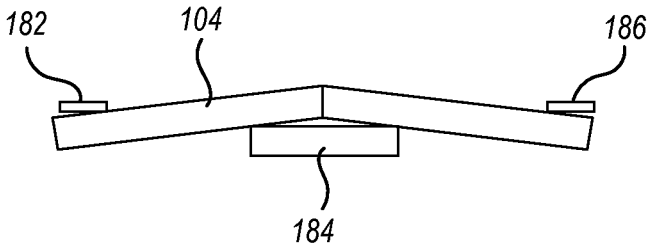
FIGS. 5A, 5B, 6A, 6B, and 6C illustrate example mechanisms for preventing the sheet material from undesirably folding up.
Figure 5B:
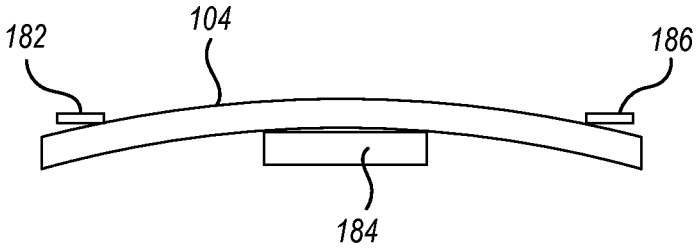

FIGS. 5A and 5B illustrate one mechanism for limiting or preventing the fanfold creases 108 from folding up the sheet material 104. FIGS. 5A and 5B illustrate a cross-sectional view of the sheet material 104 (showing the width of the sheet material 104). As can be seen, the sheet material 104 is in an arched or bowed configuration. When the sheet material 104 is in such an arched or bowed configuration, any folds (including fanfold creases 180) that extend between the opposing sides of the sheet material 104 will be forced to unfold or prevented from folding up. As a result, the sheet material 104 will be less likely to get caught or jammed in the converting machine 116.

In FIGS. 5A and 5B, the sheet material 104 is arranged or held in the arched or bowed configuration by elements 182, 184, 186. In the illustrated embodiment, elements 182, 186 engage a top surface of the sheet material 104 and element 184 engages a bottom surface of the sheet material 104. As can be seen in FIGS. 5A and 5B, the placement of element 184 relative to elements 182, 186 causes the sheet material 104 to arch or bow as shown. For instance, the lower surfaces of elements 182, 186 and the upper surface of element 184 may be generally aligned with one another. By way of example, the upper surface of element 184 may be vertically offset lower than the lower surfaces of elements 182, 186 (e.g., the surfaces may be vertically spaced apart) by a dimension that is less than the thickness of sheet material 104. In some embodiments, the upper surface of element 184 and the lower surfaces of elements 182, 186 may lie within the same vertical plane. In still other embodiments, the upper surface of element 184 may be vertically higher than the lower surfaces of elements 182, 186.

Elements 182, 184, 186 may include guide rails, belts, roller wheels, or any other suitable mechanism for arching or bowing the sheet material 104 as described. While FIGS. 5A and 5B illustrate elements 182, 186 above sheet material 104 and element 184 below sheet material 104, it will be appreciated that an inverse arrangement is contemplated, such that the sheet material 104 would arch or bow in the opposite direction.

Figure 6A:
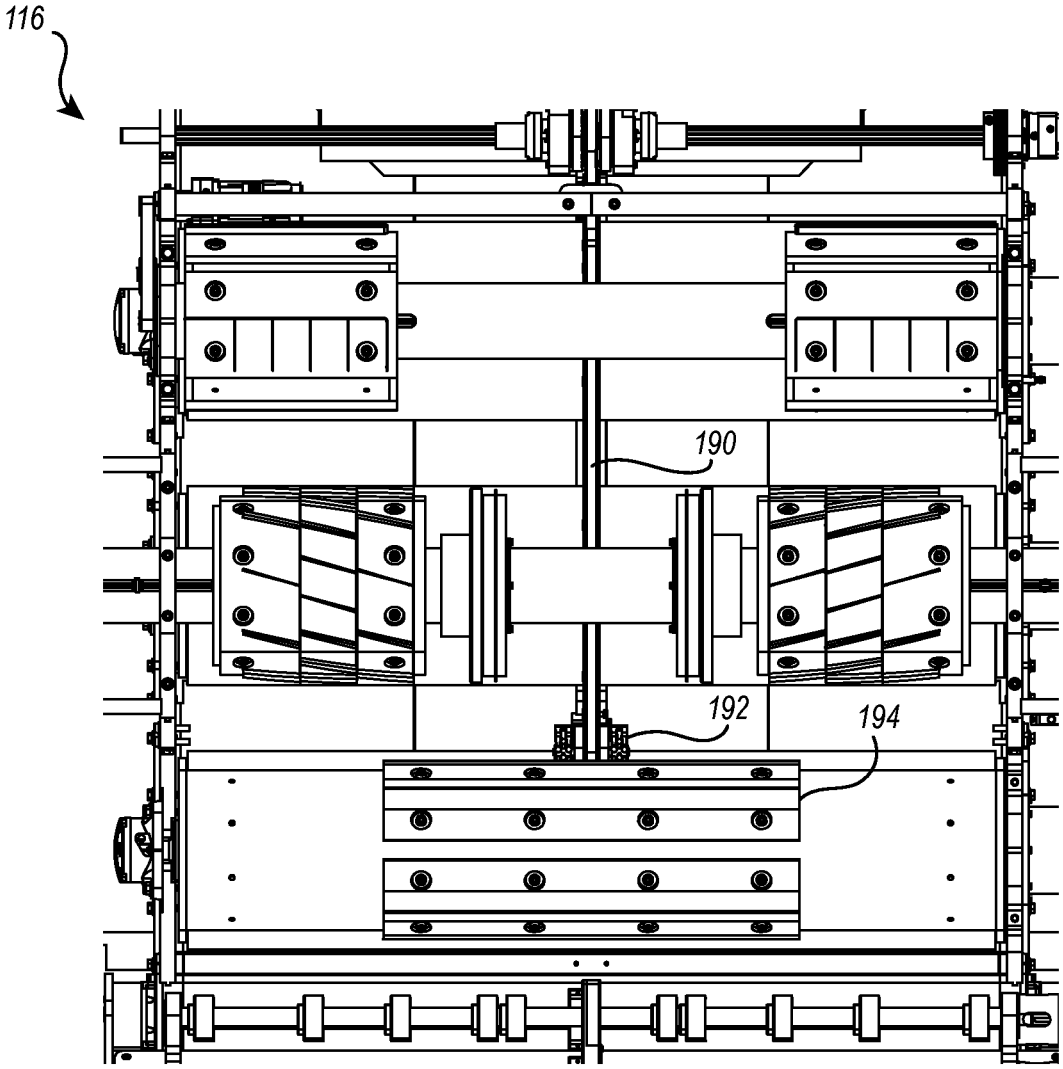
Figure 6B:
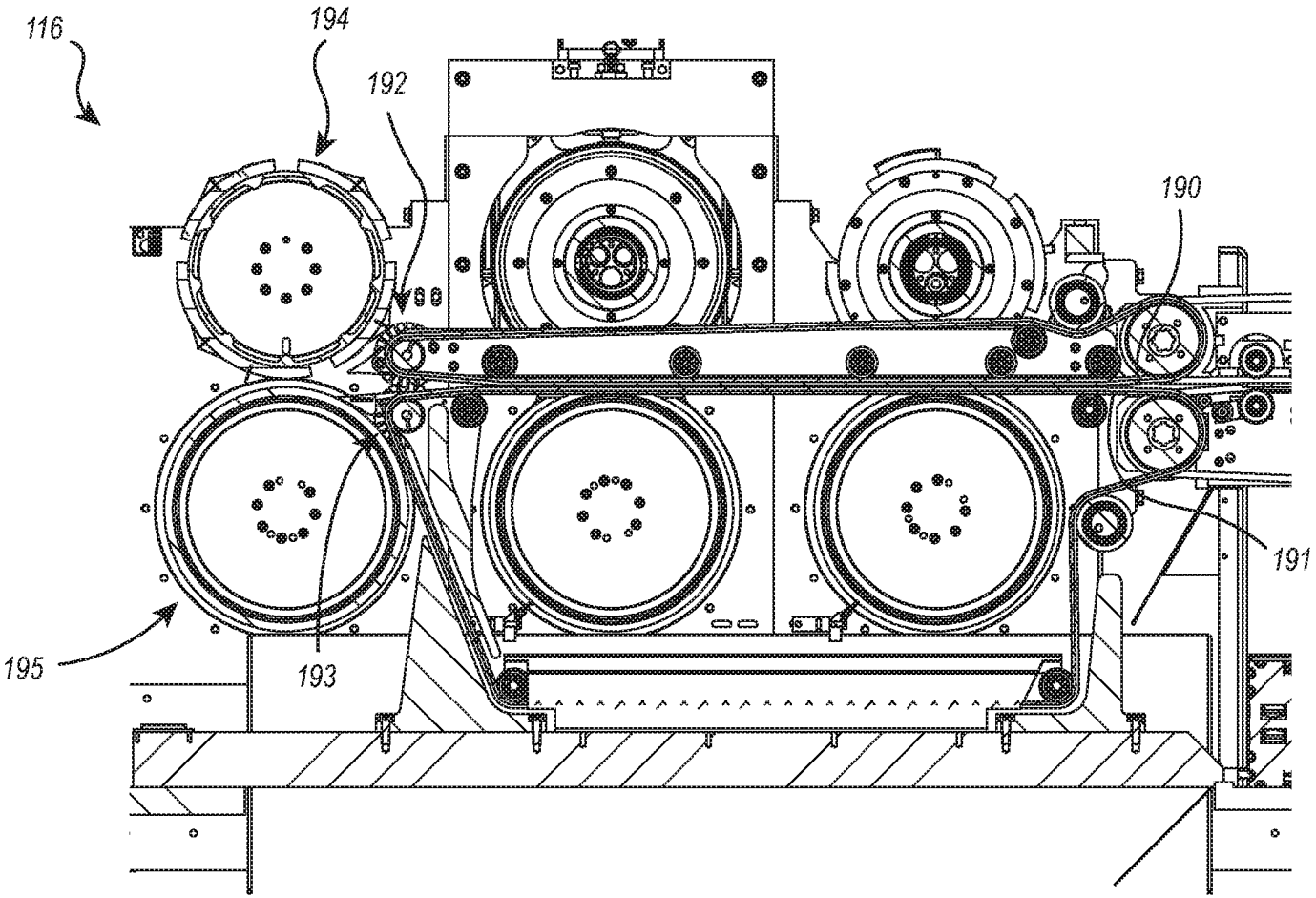
Figure 6C:
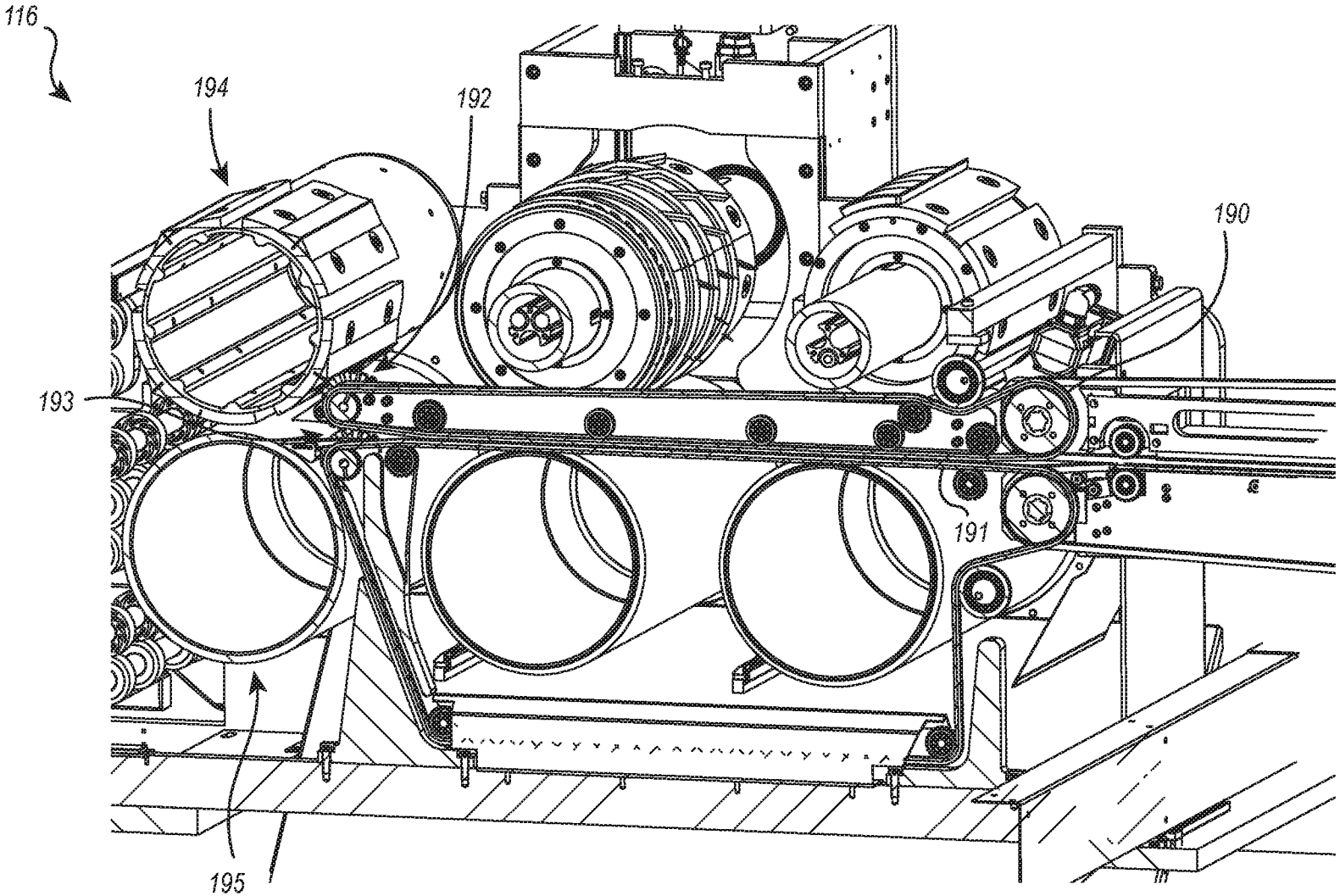

Attention is now directed to FIGS. 6A, 6B, and 6C, which illustrates other mechanisms for limiting or preventing folds (including the fanfold creases 180) from undesirably folding the sheet material 104. The mechanisms shown in FIGS. 6A, 6B, and 6C may be used in combination with or separate from one another and/or the mechanism of FIGS. 5A and 5B.

As can be seen in FIGS. 6A, 6B, and 6C, the converting assembly 116 includes opposing drive belts 190, 191 that extend at least partially therethrough and between at least some of the tool rollers and/or the support rollers. The drive belts 190, 191 can assist with advancing the sheet material 104 through the converting assembly 116. Additionally, the drive belts 190, 191 can engage the sheet material 104 to limit or prevent the sheet material 104 from folding up (e.g., at the fanfold creases 180) towards the drive belts 190, 191. While illustrated embodiment includes two drive belts (e.g., 190, 191), other embodiments may include a single drive belt (e.g., drive belt 190 or drive belt 191). Still other embodiments may include more than two drive belts.

FIGS. 6A, 6B, 6C also illustrate a series of brushes 192, 193. The brushes 192, 193 can be positioned adjacent to tool roller 194 and/or support roller 195 so that the brushes engage the sheet material 104 directly after the sheet material 104 has passed by the tool roller 194 and/or support roller 195. The brushes 192, 193 may act to limit or prevent the sheet material 104 from folding up, or even straighten out the sheet material 104 if it is folded. In some embodiments, the brushes 192, 193 limit or prevent the sheet material 104 from folding up long enough for the drive belt(s) 190, 191 and/or other drive belts to engage the sheet material 104 and limit or prevent the sheet material 104 from folding up. For example, the brushes 192, 193 may rotated in opposite direction (e.g., brushes 192 rotate counterclockwise and brushes 193 rotate clockwise in the illustrated embodiment shown in FIG. 6B), to prevent the sheet material 104 from folding in the direction of the brushes 192, 193. The peripheral speed of the brushes (e.g., near the radial tips of the brushes 192, 193) may be at least as higher or higher than the feeding speed of the sheet material 104.

A control system can control the operation of the converting machine. More specifically, the control system can control the feeding of the sheet material and the movement and/or placement of the various components of the converting machine. For instance, the control system can control the positioning of the tool rollers along the lengths of the axles or axis so that the conversion tools are positioned relative to the width of the sheet material in order to perform the conversion functions on the desired portion(s) of the sheet material. Additionally, the control system can control the rotation of the tool rollers in order to have the desired conversion tool(s) engage the sheet material at the desired location(s). In some embodiments, the control system also synchronizes the operations of the various components of the converting machines. For instance, the control system can control the feed speed of the sheet material and the rotation of the tool rollers so that the conversion tools perform the conversion functions at the desired location(s) on the sheet material.

In some embodiments, the synchronization performed by the control system is done between the times various conversion tools are engaged with the sheet material and/or the support roller(s). For instance, tool roller 120 may be rotated about the first axle or axis to disengage its conversion tools from the sheet material and/or the support roller 122. While the conversion tools of the tool roller 120 are disengaged from the sheet material, the sheet material can be (or continue to be) advanced into or through the converting assembly. Based at least in part on the speed at which the sheet material is advancing, the control system can control when and in what direction to rotate the tool roller 120 so that a particular conversion tool thereon will engage the sheet material so that the particular tool engages the proper location on the sheet material. Similarly, the rotation of the tool rollers 128*a*, 128*b* on the third axle or about the third axis can be controlled to engage or disengage particular conversion tools with the sheet material based at least in part on the speed of the sheet material advancement.

The control system can coordinate the speed of the sheet material advancement and the rotation (direction and timing) of the tool rollers so that the desired conversion tools on the various tool rollers engage the sheet material at desired locations on the sheet material. To adjust the size of the packaging templates, the control system may increase or decrease the speed of the sheet material advancement (e.g., by adjusting the rotational speed of one or more of the support rollers or drive belts) and/or the timing of when the tool rollers are rotated into engagement with the sheet material.

Furthermore, the control system can control the transverse adjustments of the tool rollers along the lengths of their respective axles or axis. For instance, in the time between engagement with portions of the sheet material that will form successive packaging templates, the control system can cause the tool rollers to be repositioned along the lengths of their respective axles or axis. By way of example, referring to FIG. 2A, after tool rollers 124*a*, 124*b*, 124*c*, 124*d* have finished performing conversion functions on a packaging template and before beginning to perform conversion functions on a subsequent packaging template, the control system can cause the tool rollers 124*a*, 124*b*, 124*c*, 124*d* to be repositioned along the second axle or axis based on the dimensions of the subsequent packaging template. The control system can coordinate such adjustment so that it takes place between successive packaging templates. In some embodiments, the control system coordinates such adjustments at least partially based on the speed of the sheet material advancement and/or the timing of when previous conversion functions (e.g., performed by the tool roller 120) were performed.

It will be appreciated that the number, placement, and ordering of the conversion tools can vary from one embodiment to another. For instance, the conversion tools may vary based on the type or style of packaging template being formed. Furthermore, while the tool rollers and the support rollers have been illustrated as having generally circular cross-sections, such is merely exemplary. For instance, in some embodiments, one or more tool rollers and/or support rollers may have a non-circular cross-section, such as oval, square, etc. It will also be appreciated that the control system can synchronize the tool rollers and/or the sheet material advancement speed in order to adjust at least some of the dimensions of the packaging template without having to replace or reorder the conversion tools.

In some embodiments, a converting machine according to the present disclosure may include one or more sensors. The one or more sensors may detect the current positions or other operating parameters of the various components of the machine (e.g., tool rollers, conversion tools, sheet material, advancement mechanisms, etc.). The one or more sensors may communicate the detected information to the control system to enable the control system to effectively and accurately control the operation of the converting machine.

In light of the above, it will be understood that a converting assembly according to the present disclosure may include a plurality of roller sets. Each roller set may include one or more tool rollers with one or more conversion tools thereon. Each roller set may also include one or more support rollers opposite the tool rollers to support the sheet material as the conversion tools perform one or more conversion functions on the sheet material. It will also be understood that the order or arrangement of the roller sets and the conversion tools associated therewith may vary from one embodiment to the next.

It will also be understood that a converting assembly as disclosed herein may provide for symmetrical movement of tool rollers on common axles or axis. For example, if an axle or axis includes a set of tool rollers, the tool rollers may move symmetrically (e.g., equal distance in opposite directions) along the length of the axle or axis. As a result, the converting assembly can form packaging templates the are symmetrical across their lengths.

It will also be understood that a converting assembly as disclosed herein may provide for asymmetrical movement of tool rollers on common axles or axis. For example, if an axle or axis includes a set of tool rollers, the tool rollers may move asymmetrically (e.g., non-equal distances and/or in common directions) along the length of the axle or axis. As a result, the converting assembly can form packaging templates the are asymmetrical across their lengths.

A converting assembly as described herein may provide a variety of benefits and advantages over existing technologies. For instance, by providing conversion tools on different rollers, including rollers on different axles or axis, the speed at which the sheet material can be converted into packaging templates of different sizes can be dramatically increased. The increased speed can be achieved, at least in part, because some of the tool rollers can be repositioned or reoriented in preparation for performing certain conversion functions while the conversion tools on other tool rollers are performing conversion functions. In other words, the converting assemblies disclosed herein can run at a continuous or nearly continuous (and usually a higher) rate. In contrast, existing technologies require starts and stops during the conversion process in order to provide time to readjust the conversion tools.

Furthermore, the ability to adjust the position and/or orientation of the tool rollers "on the fly" enables the converting assemblies disclosed herein to be particularly useful when making templates of various sizes. As used herein, adjusting the position and/or orientation of the tool rollers "on the fly" includes adjusting the position or orientation of at least some of the tool rollers after they perform conversion functions to form a first packaging template and before they perform conversion function to form a second packaging template. As used herein, adjusting the position and/or orientation of the tool rollers "on the fly" can also include adjusting the position and/or orientation of at least some of the tool rollers while some of the other tool rollers are still performing conversion functions on the sheet material. Such on the fly adjustments can significantly increase the throughput of the converting assembly. Additionally, such on the fly adjustments can allow for packaging template batch sizes as small as a single packaging template to be formed without significantly or noticeably reducing the throughput of the converting assembly.

The noted benefits are particularly useful when packaging templates of various sizes are being made, rather than large batches of one size packaging temple. For instance, in the e-commerce field, the size of to-be-packaged items can vary from one order to the next. As a result, a converting machine that can rapidly adjust to the continuously changing requirements (e.g., sizes) for packaging templates can increase the speed at which orders can be processed (e.g., packaged and shipped).

In light of the disclosure herein, a converting assembly for performing a plurality of conversion functions on sheet material to convert the sheet material into packaging templates may include a plurality of tool rollers. Each of the tool rollers may have one or more conversion tools thereon. The one or more conversion tools on an individual tool roller may be configured to perform a subset of the plurality of conversion functions that convert the sheet material into packaging templates.

In some embodiments, at least some of the plurality of tool rollers are arranged in a series adjacent to one another such that the plurality of tool rollers engage the sheet material sequentially.

In some embodiments, the plurality of tool rollers comprises a first tool roller on a first axle and at least two tool rollers on a second axle. The first tool roller may be selectively rotatable on or about the first axle to selectively engage the one or more conversion tools thereon with the sheet material. The at least two tool rollers on the second axle may be selectively rotatable on or about the second axle to selectively engage the one or more conversion tools on the at least two tool rollers with the sheet material.

In some embodiments, the first tool roller comprises one or more separation knives configured to transversely cut the sheet material into separate pieces that can be converted into separate packaging templates. The separate pieces may be arranged successively in a feeding direction of the sheet material.

In some embodiments, the first tool roller further comprises one or more transverse creasing tools configured to form transverse creases in the sheet material as part of the conversion of the sheet material into packaging templates.

In some embodiments, the first tool roller comprises one or more transverse creasing tools configured to form transverse creases in the sheet material as part of the conversion of the sheet material into packaging templates.

In some embodiments, the at least two tool rollers on the second axle comprise first and second tool rollers. Each of the first and second tool rollers comprises a longitudinal creasing tool configured to form a longitudinal crease in the sheet material as part of the conversion of the sheet material into packaging templates.

In some embodiments, the first and second tool rollers are configured to be selectively moved along a length of the second axle.

In some embodiments, the first and second tool rollers are configured to move symmetrically along the length of the second axle about a centerline of the converting assembly.

In some embodiments, the at least two tool rollers on the second axle comprises third and fourth tool rollers. Each of the third and fourth tool rollers comprises a side trim knife configured to trim off excess side trim from the sheet material as part of the conversion of the sheet material into packaging templates.

In some embodiments, the third and fourth tool rollers are configured to be selectively moved along the length of the second axle.

In some embodiments, the third and fourth tool rollers are configured to move symmetrically along the length of the second axle about a centerline of the converting assembly.

In some embodiments, each of the third and fourth tool rollers comprises one or more additional knives that are configured to cut the excess side trim from the sheet material into smaller pieces.

In some embodiments, an attraction element is included and that is configured to attract the smaller pieces of cut side trim to a desired area.

In some embodiments, the plurality of tool rollers comprises at least two tool rollers on a third axle. The at least two tool rollers on the third axle are selectively rotatable on or about the third axle to selectively engage the one or more conversion tools on the at least two tool rollers on the third axle with the sheet material.

In some embodiments, the at least two tool rollers on the third axle comprise first and second tool rollers on the third axle. Each of the first and second tool rollers on the third axle comprises one or more flap knives configured to form cuts in the sheet material to at least partially define flaps in the packaging templates.

In some embodiments, the at least two tool rollers on the third axle comprise first and second tool rollers on the third axle. Each of the first and second tool rollers on the third axle comprises one or more longitudinal knives configured to form longitudinal cuts in the sheet material.

In some embodiments, the at least two tool rollers on the third axle are configured to be selectively moved along a length of the third axle.

In some embodiments, the at least two tool rollers are configured to move symmetrically along the length of the third axle about a centerline of the converting assembly.

In some embodiments, one or more resilient members are positioned adjacent to one or more of the one or more conversion tools.

In some embodiments, a drive belt is provided to assist with advancing the sheet material through the converting assembly.

In some embodiments, the drive belt is configured to limit or prevent the sheet material from folding up or down as the sheet material advances through the sheet material.

In some embodiments, one or more brushes are positioned adjacent to at least one of the tool rollers. The one or more brushes are configured to limit or prevent the sheet material from folding up or down after the sheet material passes by the at least one of the tool rollers.

In some embodiments, one or more support rollers are provided.

In some embodiments, the one or more support rollers comprise a single support roller positioned opposite the plurality of tool rollers.

In some embodiments, the one or more support rollers comprise a support roller positioned opposite to each of the plurality of tool rollers.

In some embodiments, for at least one of the one or more conversion tools, only a portion of the at least one conversion tool is used to perform a conversion function for a packaging template having a first size and all of the at least one conversion tool is used to perform a conversion function for a packaging template having a second size.

In some embodiments, one or more of the tool rollers are configured to have their conversion tools disengaged from the sheet material and repositioned or reoriented while one or more of the other tool rollers are performing conversion functions on the sheet material.

In another embodiment, a converting machine for converting sheet material into packaging templates includes a feed changer and a converting assembly. The feed changer is configured to selectively feed sheet materials having different characteristics into the converting machine. The converting assembly is configured to perform a plurality of conversion functions on the sheet material to convert the sheet material into packaging templates. The converting assembly includes at least first and second roller sets. The first roller set comprises a first tool roller on a first axle or axis. The first tool roller comprises one or more transverse conversion tools thereon and is selectively rotatable on or about the first axle or axis to selectively engage the one or more transverse conversion tools thereon with the sheet material. The second roller set comprises at least first and second tool rollers on a second axle or axis. Each of the first and second tool rollers on the second axle or axis comprises one or more transverse conversion tools and/or one or more longitudinal conversion tools thereon. The first and second tool rollers are selectively rotatable on or about the second axle or axis to selectively engage the one or more transverse conversion tools and/or the one or more longitudinal conversion tools thereon with the sheet material. The first and second tool rollers are selectively movable along a length of the second axle or axis to reposition the one or more transverse conversion tools and/or the one or more longitudinal conversion tools relative to the sheet material.

In some embodiments, the second roller set further comprises third and fourth tool rollers on the second axle. Each of the third and fourth tool rollers comprises one or more transverse conversion tools and/or the one or more longitudinal conversion tools.

In some embodiments, the converting assembly further comprises a third roller set having at least first and second tool rollers on a third axle or axis. Each of the first and second tool rollers on the third axle or axis has one or more transverse conversion tools and/or the one or more longitudinal conversion tools.

In some embodiments, the movements of the first and second tool rollers are symmetrical about a centerline of the converting assembly.

In some embodiments, the feed changer is configured to change which sheet material is fed into the converting machine even while the converting assembly completes the conversion functions on a previous packaging template.

In some embodiments, an advancement mechanism is configured to advance the sheet material through the converting machine.

In some embodiments, the advancement mechanism comprises one or more support rollers positioned opposite to the tool roller.

In some embodiments, the advancement mechanism comprises one or more drive belts.

In some embodiments, a control system is configured to synchronize the movements of the tool rollers and a speed at which the advancement mechanism advances the sheet material through the converting machine.

In some embodiments, the control system is configured to rotate the tool rollers to engage the conversion tools with predetermined portions of the sheet material.

In some embodiments, the control system is configured to rotate the tool rollers to engage the conversion tools with predetermined portions of the sheet material at least partially based on the advancement speed of the sheet material.

In some embodiments, the control system is configured to cause the first and second tool rollers on the second axle or axis to be repositioned along the length of the second axle or axis after performing conversion functions to form a first packaging template and prior to performing conversion function to form a second packaging template.

In some embodiments, a mechanism is provided for preventing the sheet material from undesirably folding.

In some embodiments, the mechanism for preventing the sheet material from undesirably folding comprises a plurality of retention elements arranged and configured to hold the sheet material in a bow or arch shape.

In some embodiments, holding the sheet material in a bow or arch shape is configured to keep the sheet material straight in a direction perpendicular to a curvature of the bow or arch, even when the sheet material includes fanfold creased therein.

In some embodiments, the direction perpendicular to a curvature of the bow or arch is parallel to a feed direction of the sheet material through the converting machine.

In some embodiments, the mechanism for preventing the sheet material from undesirably folding comprises one or more rotatable brushes that engages the sheet material and rotates to prevent the sheet material from folding, or even straighten it out if already folded.

According to another embodiment, a method for performing a plurality of conversion functions on sheet material to convert the sheet material into packaging templates includes performing a first subset of conversion functions of the plurality of conversion functions on the sheet material with one or more tool rollers on a first axle or axis and performing a second subset of conversion functions of the plurality of conversion functions on the sheet material with one or more tool rollers on a second axle or axis.

In some embodiments, performing a first subset of conversion functions comprises performing a single conversion function on the sheet material.

In some embodiments, performing a single conversion function comprises cutting the sheet material into separate pieces for use in making separate packaging templates. The separate pieces are arranged successively in a feeding direction of the sheet material.

In some embodiments, performing a first subset of conversion functions comprises performing first and second conversion functions on the sheet material.

In some embodiments, performing the first and second conversion functions comprising performing a separation cut and one or more transverse creases in the sheet material.

In some embodiments, performing a second subset of conversion functions on the sheet material comprises forming one or more longitudinal creases in the sheet material with a set of tool rollers on the second axle or axis.

In some embodiments, performing a second subset of conversion functions on the sheet material comprises cutting side trim from the sheet material with a second set of tool rollers on the second axle or axis.

In some embodiments, the method also includes performing a third subset of conversion functions on the sheet material with one or more tool rollers on a third axle or axis.

In some embodiments, performing a third subset of conversion functions comprises forming one or more transverse cuts in the sheet material with a set of tool rollers on the third axle or axis. The one or more transverse cuts at least partially define one or more flaps of the packaging template.

In some embodiments, performing a third subset of conversion functions further comprises forming one or more longitudinal cuts in the sheet material with a set of tool rollers on the third axle or axis. The one or more longitudinal cuts at least partially define a glue flap of the packaging template.

In some embodiments, the method also includes advancing the sheet material at a generally constant speed while performing the plurality of conversion functions on sheet material to convert the sheet material into packaging templates.

In some embodiments, performing a second subset of conversion functions comprises adjusting the positions of a set of tool rollers along a length of the second axle or axis of a set of tool rollers.

In some embodiments, adjusting the positions of a set of tool rollers comprises symmetrically moving the tool rollers along the length of the second axle or axis.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A converting assembly for performing a plurality of conversion functions, including cuts and creases, on sheet material to convert the sheet material into packaging templates, the converting assembly comprising:

a plurality of tool rollers comprising a first tool roller on a first axle and at least two tool rollers on a second axle, each of the tool rollers having one or more conversion tools thereon, the one or more conversion tools comprising one or more knives and/or creasing tools, the one or more conversion tools on an individual tool roller being configured to perform a subset of the plurality of conversion functions that convert the sheet material into packaging templates, the first tool roller being rotatable on or about the first axle and the at least two tool rollers being rotatable on or about the second axle, first and second tool rollers of the at least two tool rollers being configured to move symmetrically along the length of the second axle relative to a centerline of the converting assembly such that the first and second tool rollers of the at least two tool rollers simultaneously move away from one another towards opposing ends of the second axle or towards each other near the centerline of the converting assembly, the first and second tool rollers of the at least two tool rollers each comprise a longitudinal creasing tool configured to form a longitudinal crease in the sheet material as part of the conversion of the sheet material into packaging templates, third and fourth tool rollers of the at least two tool rollers on the second axle comprise a side trim knife configured to trim off excess side trim from the sheet material as part of the conversion of the sheet material into packaging templates; and a control system configured to cause the symmetrical movement of the first and second tool rollers of the at least two tool rollers.

2. The converting assembly of claim 1, wherein at least some of the plurality of tool rollers are arranged in a series adjacent to one another such that the plurality of tool rollers engage the sheet material sequentially.

3. The converting assembly of claim 1, wherein the first tool roller is selectively rotatable on or about the first axle to selectively engage the one or more conversion tools thereon with the sheet material, and the at least two tool rollers on the second axle are selectively rotatable on or about the second axle to selectively engage the one or more conversion tools on the at least two tool rollers with the sheet material.

4. The converting assembly of claim 3, wherein the first tool roller comprises one or more separation knives, the one or more separation knives being configured to transversely cut the sheet material into separate pieces that can be converted into separate packaging templates, wherein the separate pieces are arranged successively in a feeding direction of the sheet material.

5. The converting assembly of claim 4, wherein the first tool roller further comprises one or more transverse creasing tools, the one or more transverse creasing tools being configured to form transverse creases in the sheet material as part of the conversion of the sheet material into packaging templates.

6. The converting assembly of claim 3, wherein the first tool roller comprises one or more transverse creasing tools, the one or more transverse creasing tools being configured to form transverse creases in the sheet material as part of the conversion of the sheet material into packaging templates.

7. The converting assembly of claim 3, wherein the plurality of tool rollers comprises at least two tool rollers on a third axle, the at least two tool rollers on the third axle being selectively rotatable on or about the third axle to selectively engage the one or more conversion tools on the at least two tool rollers on the third axle with the sheet material.

8. The converting assembly of claim 7, wherein the at least two tool rollers on the third axle comprise first and second tool rollers on the third axle, each of the first and second tool rollers on the third axle comprising one or more flap knives, the one or more flap knives being configured to form cuts in the sheet material to at least partially define flaps in the packaging templates.

9. The converting assembly of claim 7, wherein the at least two tool rollers on the third axle comprise first and second tool rollers on the third axle, each of the first and second tool rollers on the third axle comprising one or more longitudinal knives configured to form longitudinal cuts in the sheet material.

10. The converting assembly of claim 7, wherein the at least two tool rollers on the third axle are configured to be selectively moved along a length of the third axle.

11. The converting assembly of claim 10, wherein the at least two tool rollers on the third axle are configured to move symmetrically along the length of the third axle relative to a centerline of the converting assembly, such that the at least two tool rollers simultaneously move away from one another towards opposing ends of the third axle or towards each other near the centerline of the converting assembly.

12. The converting assembly of claim 1, wherein the first and second tool rollers of the at least two tool rollers are configured to be selectively moved along a length of the second axle.

13. The converting assembly of claim 12, wherein the first tool roller is rotatable independent from the at least two tool rollers.

14. The converting assembly of claim 1, wherein the third and fourth tool rollers are configured to be selectively moved along a length of the second axle.

15. The converting assembly of claim 14, wherein the third and fourth tool rollers are configured to move symmetrically along the length of the second axle relative to a centerline of the converting assembly.

16. The converting assembly of claim 1, wherein each of the third and fourth tool rollers comprises one or more additional knives that are configured to cut the excess side trim from the sheet material into smaller pieces.

17. The converting assembly of claim 16, further comprising an attraction element configured to attract the smaller pieces of cut side trim to a desired area.

18. The converting assembly of claim 1, further comprising one or more resilient members positioned adjacent to one or more of the one or more conversion tools, the one or more resilient members being configured to facilitate withdrawal of the one or more conversion tools from the sheet material after the one or more conversion tools perform the conversion functions on the sheet material.

19. The converting assembly of claim 1, further comprising a drive belt, the drive belt being configured to assist with advancing the sheet material through the converting assembly.

20. The converting assembly of claim 19, wherein the drive belt is configured to limit or prevent the sheet material from folding up or down as the sheet material advances through the converting assembly.

21. The converting assembly of claim 1, further comprising one or more brushes positioned adjacent to at least one of the tool rollers, the one or more brushes being configured to limit or prevent the sheet material from folding up or down after the sheet material passes by the at least one of the tool rollers.

22. The converting assembly of claim 1, further comprising one or more support rollers.

23. The converting assembly of claim 22, wherein the one or more support rollers comprise a single support roller positioned opposite the plurality of tool rollers.

24. The converting assembly of claim 22, wherein the one or more support rollers comprise a support roller positioned opposite to each of the plurality of tool rollers.

25. The converting assembly of claim 1, wherein for at least one of the one or more conversion tools, only a portion of the at least one conversion tool is used to perform a conversion function for a packaging template having a first size and a substantial portion of the at least one conversion tool is used to perform a conversion function for a packaging template having a second size.

26. The converting assembly of claim 1, wherein one or more of the tool rollers are configured to have their conversion tools disengaged from the sheet material and repositioned or reoriented while one or more of the other tool rollers are performing conversion functions on the sheet material.

27. A converting machine for converting sheet material into packaging templates, the converting machine comprising:

an advancement mechanism configured to advance the sheet material through the converting machine; and a converting assembly configured to perform a plurality of conversion functions on the sheet material to convert the sheet material into packaging templates, the converting assembly comprising at least first and second roller sets, wherein:

the first roller set comprises a first tool roller on a first axle, the first tool roller comprising one or more transverse conversion tools thereon, the first tool roller being selectively rotatable on or about the first axle to selectively engage the one or more transverse conversion tools thereon with the sheet material, and the second roller set comprises at least first, second, third, and fourth tool rollers on a second axle, each of the first and second tool rollers on the second axle comprising one or more transverse conversion tools and/or one or more longitudinal conversion tools thereon, the first and second tool rollers being selectively rotatable on or about the second axle to selectively engage the one or more transverse conversion tools and/or the one or more longitudinal conversion tools thereon with the sheet material, the first and second tool rollers being selectively movable along a length of the second axle to reposition the one or more transverse conversion tools and/or the one or more longitudinal conversion tools relative to the sheet material, the third and fourth tool rollers each comprising a side trim knife configured to trim off excess side trim from the sheet material as part of the conversion of the sheet material into packaging templates; and a control system configured to control one or more operational parameters of the converting machine, the control system being configured to cause the first and second tool rollers to be selectively moved along the length of the second axle while the advancement mechanism continuously advances the sheet material through the converting machine.

28. The converting machine of claim 27, wherein each of the third and fourth tool rollers comprises one or more transverse conversion tools and/or one or more longitudinal conversion tools.

29. The converting machine of claim 27, wherein the converting assembly further comprises a third roller set, the third roller set having at least first and second tool rollers on a third axle, each of the first and second tool rollers on the third axle having one or more transverse conversion tools and/or one or more longitudinal conversion tools.

30. The converting machine of claim 27, wherein movements of the first and second tool rollers are symmetrical about a centerline of the converting assembly.

31. The converting machine of claim 27, further comprising a feed changer configured to selectively feed sheet materials having different characteristics into the converting machine.

32. The converting machine of claim 31, wherein the feed changer is configured to change which sheet material is fed into the converting machine even while the converting assembly completes the conversion functions on a previous packaging template.

33. The converting machine of claim 27, wherein the advancement mechanism comprises one or more support rollers positioned opposite to the tool roller.

34. The converting machine of claim 27, wherein the advancement mechanism comprises one or more drive belts.

35. The converting machine of claim 27, wherein the control system is configured to synchronize movements of the tool rollers and a speed at which the advancement mechanism advances the sheet material through the converting machine.

36. The converting machine of claim 35, wherein the control system is configured to rotate the tool rollers to engage the conversion tools with predetermined portions of the sheet material.

37. The converting machine of claim 36, wherein the control system is configured to rotate the tool rollers to engage the conversion tools with predetermined portions of the sheet material at least partially based on the advancement speed of the sheet material.

38. The converting machine of claim 35, wherein the control system is configured to cause the first and second tool rollers on the second axle to be repositioned along the length of the second axle after performing conversion functions to form a first packaging template and prior to performing conversion function to form a second packaging template.

39. The converting machine of claim 27, further comprising a mechanism for preventing the sheet material from undesirably folding.

40. The converting machine of claim 39, wherein the mechanism for preventing the sheet material from undesirably folding comprises a plurality of retention elements, the plurality of retention elements being arranged and configured to hold the sheet material in a bow or arch shape, wherein holding the sheet material in a bow or arch shape is configured to keep the sheet material straight in a direction perpendicular to a curvature of the bow or arch, even when the sheet material includes fanfold creased therein.

41. The converting machine of claim 40, wherein the direction perpendicular to a curvature of the bow or arch is parallel to a feed direction of the sheet material through the converting machine.

42. The converting machine of claim 39, wherein the mechanism for preventing the sheet material from undesirably folding comprises one or more rotatable brushes that engages the sheet material and rotates to prevent the sheet material from folding, and/or straighten out the sheet material if already folded.

43. A converting assembly for performing a plurality of conversion functions on sheet material to convert the sheet material into packaging templates, the converting assembly comprising:

a plurality of tool rollers, each of the tool rollers having one or more conversion tools thereon, the one or more conversion tools on an individual tool roller being configured to perform a subset of the plurality of conversion functions that convert the sheet material into packaging templates, the plurality of tool rollers comprising:

a first tool roller on a first axle, the first tool roller being selectively rotatable on or about the first axle to selectively engage the one or more conversion tools thereon with the sheet material; and at least two tool rollers on a second axle, the at least two tool rollers on the second axle being selectively rotatable on or about the second axle to selectively engage the one or more conversion tools on the at least two tool rollers with the sheet material, the at least two tool rollers on the second axle comprising:

first and second tool rollers, each of the first and second tool rollers comprising a longitudinal creasing tool configured to form a longitudinal crease in the sheet material as part of the conversion of the sheet material into packaging templates; and third and fourth tool rollers, each of the third and fourth tool rollers comprising a side trim knife configured to trim off excess side trim from the sheet material as part of the conversion of the sheet material into packaging templates.

44. The converting assembly of claim 43, wherein the third and fourth tool rollers are configured to be selectively moved along a length of the second axle.

45. The converting assembly of claim 44, wherein the third and fourth tool rollers are configured to move symmetrically along the length of the second axle about a centerline of the converting assembly.

46. The converting assembly of claim 43, wherein each of the third and fourth tool rollers comprises one or more additional knives that are configured to cut the excess side trim from the sheet material into smaller pieces.

47. The converting assembly of claim 46, further comprising an attraction element configured to attract the smaller pieces of cut side trim to a desired area.

* * * * *